US012595104B2

(12) United States Patent
Nakagawa et al.

(10) Patent No.: US 12,595,104 B2
(45) Date of Patent: Apr. 7, 2026

(54) CONTAINER

(71) Applicant: TOAGOSEI CO., LTD., Tokyo (JP)

(72) Inventors: Hideki Nakagawa, Takaoka (JP); Takashi Horie, Takaoka (JP); Masaru Matsumoto, Tokai (JP); Yuuki Hayakawa, Tokai (JP); Noriaki Date, Tokai (JP)

(73) Assignee: TOAGOSEI CO., LTD., Tokyo (JP)

( * ) Notice: Subject to any disclaimer, the term of this patent is extended or adjusted under 35 U.S.C. 154(b) by 209 days.

(21) Appl. No.: 18/253,505

(22) PCT Filed: Nov. 17, 2021

(86) PCT No.: PCT/JP2021/042279

§ 371 (c)(1),
(2) Date: May 18, 2023

(87) PCT Pub. No.: WO2022/107825

PCT Pub. Date: May 27, 2022

(65) Prior Publication Data

US 2024/0002124 A1 Jan. 4, 2024

(30) Foreign Application Priority Data

Nov. 20, 2020 (JP) ..... 2020-193893

(51) Int. Cl.
*B65D 35/28* (2006.01)
*B65D 47/12* (2006.01)
(Continued)

(52) U.S. Cl.
CPC ..... *B65D 77/0486* (2013.01); *B65D 47/122* (2013.01); *B65D 65/38* (2013.01); *B65D 2577/041* (2013.01)

(58) Field of Classification Search
CPC ..... B65D 77/0486; B65D 2231/00; B65D 35/28; B65D 83/765; B65D 83/771; B65D 83/0094
(Continued)

(56) References Cited

U.S. PATENT DOCUMENTS 1,007,619 A * 10/1911 Vogelmann ..... B43K 5/04 401/232
2,492,830 A * 12/1949 Bannister ..... A47G 19/24 222/190
(Continued)

FOREIGN PATENT DOCUMENTS

JP H06191544 7/1994
JP H08048358 2/1996
(Continued)

OTHER PUBLICATIONS

PCT International Search Report (w/ English translation) and Written Opinion for corresponding PCT Application No. PCT/JP2021/042279, mailed Jan. 25, 2022, 12 pages.

*Primary Examiner* — Charles P. Cheyney
(74) *Attorney, Agent, or Firm* — Dority & Manning, PA

(57) ABSTRACT

A container including: an inner container having a nozzle portion that discharges loaded content; an outer container that is tubular, is formed of a hard resin, contains the inner container, and has an outer peripheral wall in which an opening portion is formed; a pressing portion formed of an elastomer, provided at the outer peripheral wall, and covering the opening portion; and a cap that is attachable to and removable from the outer container, and that covers the nozzle portion that projects out from the outer container.

12 Claims, 10 Drawing Sheets

(51) Int. Cl.
*B65D 65/38* (2006.01)
*B65D 77/04* (2006.01)

(58) Field of Classification Search
USPC ..... 222/105, 213, 214, 183
See application file for complete search history.

(56) References Cited

U.S. PATENT DOCUMENTS 2,715,236 A * 8/1955 Tereno ..... A46B 11/0055 401/184
4,958,748 A * 9/1990 Otake ..... B43M 11/08 401/161
5,020,930 A * 6/1991 Kuhn ..... B05B 11/0005 401/262
5,259,682 A * 11/1993 Uchiyama ..... B43K 23/08 401/269
5,388,726 A * 2/1995 Otake ..... B65D 83/0094 222/83
5,505,342 A 4/1996 Okamura et al.
5,649,648 A * 7/1997 Lier ..... B65D 1/32 222/206
5,909,828 A * 6/1999 Salisbury ..... B05C 17/00583 222/105
5,934,457 A * 8/1999 Ueda ..... B65D 77/0493 215/250
7,264,141 B2 * 9/2007 Patel ..... B65D 83/7713 222/182
7,665,923 B2 * 2/2010 Py ..... G01F 11/08 401/265
8,056,748 B2 * 11/2011 Chen ..... B65D 50/041 220/255
11,383,265 B2 * 7/2022 Rushe ..... B05C 17/00596
11,827,437 B2 * 11/2023 Lee ..... B65D 47/2081
2007/0218229 A1 * 9/2007 Nagahama ..... B65D 35/28 428/34.1
2010/0256556 A1 * 10/2010 Cray, Jr. ..... A61P 35/00 604/93.01
2015/0314637 A1 11/2015 Kobayashi et al.
2019/0001368 A1 1/2019 Rushe et al.

FOREIGN PATENT DOCUMENTS

JP H10337523 12/1998
JP 2002308331 10/2002
JP 2004182249 7/2004
JP 3897199 3/2007
JP 2007276879 10/2007
JP 2008230692 10/2008
JP 5212579 6/2013
JP 2019508236 3/2019
JP 2021011552 2/2021
WO WO2014068799 5/2014

* cited by examiner

CONTAINER

CROSS-REFERENCE TO RELATED APPLICATIONS

The present application is related and has right of priority to JP 2020-193893, which was filed on Nov. 20, 2020 in the Japanese Patent Office, and is a U.S. national phase entry of PCT/JP2021/042279, which was filed on Nov. 17, 2021, both of which are incorporated by reference in their entireties for all purposes.

TECHNICAL FIELD

The present disclosure relates to a container.

BACKGROUND ART

Japanese Patent Application National Publication No. 2019-508236 discloses a device for applying an adhesive and/or a sealing agent, the device having a housing for accommodating a container, wherein the housing includes: an accommodating space for accommodating the container; an application distal end portion that is closable, is connected to the accommodating space, and from which the adhesive and/or the sealing agent can be discharged; a stable casing for the accommodating space; and at least one region of the housing that is designed to be a pressure region that is deformable, and at which pressure from the exterior can be applied to the container that can be disposed within the accommodating space.

PRIOR ART DOCUMENTS

Patent Documents

Patent Document 1: Japanese Patent Application National Publication No. 2019-508236

SUMMARY OF INVENTION

Technical Problem

However, in the device disclosed in Japanese Patent Application National Publication No. 2019-508236, the pressure region that is deformable and at which pressure is applied to the container is a plate spring structured by forming slits in the housing. As is clear therefrom, this device does not take the sealability of the housing itself into consideration. Further, in the device disclosed in above-described Patent Document 1, the application distal end portion is not accommodated in the housing, and a closing cap covers only a portion of the application distal end portion. Namely, in the device disclosed in above-described Patent Document 1, the sealability of the container by the housing is not ensured, and the entire application distal end portion is not protected. Therefore, it is easy for permeation of air into the container and deterioration of the application distal end portion to arise, and there is the concern that the adhesive and/or sealing agent within the container will deteriorate.

Further, in the device disclosed in Japanese Patent Application National Publication No. 2019-508236, the plate spring does not flex, and pressure cannot be applied to the container, if the free end portion of the plate spring is not pressed.

The present disclosure was developed in view of the current circumstances described above, and provides a container whose air barrier property is improved and at which contents of an inner container that is contained in an outer container can be expelled easily.

Solution to Problem

A container relating to a first aspect comprises: an inner container having a nozzle portion that discharges loaded content; an outer container that is tubular, is formed of a hard resin, contains the inner container, and has an outer peripheral wall in which an opening portion is formed; a pressing portion formed of an elastomer, provided at the outer peripheral wall, and covering the opening portion; and a cap that is attachable to and removable from the outer container, and that covers the nozzle portion that projects-out from the outer container.

In a container relating to a second aspect, the container of the first aspect further comprises a base at an end portion of the outer container at an opposite side from the cap.

In a container relating to a third aspect, in the container of the first aspect or the second aspect, a pair of the opening portions covered by the pressing portions are provided so as to have axial symmetry with respect to a central axis of the outer container.

In a container relating to a fourth aspect, the container of the third aspect further comprises a connecting portion that is made of an elastomer and integrally connects the pair of pressing portions as if wound on the outer peripheral wall of the outer container.

In a container relating to a fifth aspect, the container of the fourth aspect further comprises an extending portion that is made of an elastomer and extends from the connecting portion toward the base of the outer container.

In a container relating to a sixth aspect, in the container of any one aspect of the first aspect through the fifth aspect, a plurality of ribs are formed at an outer peripheral portion of the cap.

In a container relating to a seventh aspect, in the container of any one aspect of the first aspect through the sixth aspect, a diameter of the outer peripheral wall of the outer container increases from an end portion at a side of the cap toward the base.

In a container relating to an eighth aspect, in the container of any one aspect of the first aspect through the seventh aspect, the content is an adhesive.

In a container relating to a ninth aspect, in the container of the eighth aspect, the inner container is made of polyolefin.

In a container relating to a tenth aspect, in the container of the ninth aspect, the cap is made of polyolefin.

In a container relating to an eleventh aspect, the container of any one aspect of the second aspect through the tenth aspect comprises a drying agent at an inner side of the base.

In a container relating to a twelfth aspect, in the container of any one aspect of the first aspect through the eleventh aspect, a concave portion is formed at a surface of the pressing portion.

In a container relating to a thirteenth aspect, in the container of any one aspect of the first aspect through the twelfth aspect, the pressing portion has a bulging portion that bulges out further than the outer peripheral wall of the outer container.

In a container relating to a fourteenth aspect, in the container of the thirteenth aspect, a maximum thickness of the bulging portion is within a range of from 0.2 mm to 1.0 mm.

In a container relating to a fifteenth aspect, in the container of any one aspect of the first aspect through the fourteenth aspect, a hardness A of the elastomer is within a range of 40 to less than 80.

In a container relating to a sixteenth aspect, in the container of any one aspect of the first aspect through the fifteenth aspect, water vapor permeability at a sample of a thickness of 0.5 mm of the elastomer, as measured in accordance with JIS Z 0208, is less than 2.0 $g/m^2 \cdot 24$ h.

In a container relating to a seventeenth aspect, in the container of any one aspect of the first aspect through the sixteenth aspect, oxygen permeability of the elastomer, as measured in accordance with JIS K 7126, is less than $1.0 \times 10^{-15}$ $mol \cdot m/Pa \cdot s \cdot m^2$.

Advantageous Effects of Invention

In accordance with the container relating to the first aspect, the opening portion that is formed in the outer peripheral wall of the outer container is covered by the pressing portion that is made of an elastomer. Due thereto, the contents filled in the inner container can easily be expelled from the nozzle portion due to the pressing portion being pressed by a finger and the inner container being pressed.

Further, in accordance with the container relating to the first aspect, the cap is attached to the outer container, and covers the nozzle portion that projects-out from the outer container. Therefore, as compared with a structure in which the cap is detachably provided at the inner container, the air barrier property of the container can be improved.

Further, in accordance with the container relating to the first aspect, the inner container is contained in the outer container that is tubular and is made of a hard resin. Due thereto, even if the container is inadvertently pressed, the contents being expelled from the nozzle portion of the inner container is suppressed.

In accordance with the container relating to the second aspect, the container can be stood-up on a work table or the like in a state in which the base is down and the nozzle portion is made to face upward.

In accordance with the container relating to the third aspect, at the time of pressing the pair of pressing portions and expelling the contents from the nozzle portion, it is easy for the pair of pressing portions to be pinched and pressed by the thumb and index finger.

In accordance with the container relating to the fourth aspect, peeling-off of the pressing portions from the outer container is suppressed as compared with a structure in which the pair of pressing portions are not connected integrally.

In accordance with the container relating to the fifth aspect, as compared with a structure that does not have the first extending portion, peeling of the pressing portions from the outer container is suppressed.

In accordance with the container relating to the sixth aspect, it is easy to grasp the cap at the time of attaching/removing the cap.

In accordance with the container relating to the seventh aspect, the diameter of the outer container increases from the end portion at the cap side toward the base. Therefore, it is difficult for the container to fall over when placed on a work table or the like with the nozzle portion facing up.

In accordance with the container relating to the eighth aspect, it is difficult for the adhesive that is filled in the inner container to deteriorate at times of non-usage.

In accordance with the container relating to the ninth aspect, it is difficult for the adhesive that remains at the interior of the inner container to harden.

In accordance with the container relating to the tenth aspect, it is difficult for the adhesive that remains in the distal end portion of the nozzle portion, which is covered by the cap, to harden.

In accordance with the container relating to the eleventh aspect, the internal space of the container can be dried.

In accordance with the container relating to the twelfth aspect, the thumb and index finger can be fit in the concave portions when pressing the pressing portions.

In accordance with the container relating to the thirteenth aspect, the positions of the pressing portions can be distinguished by touch.

In accordance with the container relating to the fourteenth aspect, as compared with a structure in which the maximum thickness of the bulging portion is less than 0.2 mm, it is easy to distinguish the positions of the pressing portions by touch. Further, as compared with a structure in which the maximum thickness of the bulging portion exceeds 1.0 mm, it is easy to press the inner container by pressing the pressing portions by the thumb and index finger.

In accordance with the container relating to the fifteenth aspect, as compared with a structure in which the A hardness of the elastomer is less than 40, it is easy to adjust the amount of the contents that is expelled by pressing the pressing portions. Further, as compared with a structure in which the A hardness of the elastomer is greater than or equal to 80, it is easy to adjust the amount of the contents that is expelled by pressing the pressing portions.

In accordance with the container relating to the sixteenth aspect, the water vapor barrier property of the container is improved as compared with a structure in which the water vapor permeability of the elastomer at a sample of a thickness of 0.5 mm is greater than or equal to 2.0 $g/m^2 \cdot 24$ h.

In accordance with the container relating to the seventeenth aspect, the air barrier property of the container is improved as compared with a structure in which the oxygen permeability of the elastomer is greater than or equal to $1.0 \times 10^{-15}$ $mol \cdot m/Pa \cdot s \cdot m^2$.

DESCRIPTION OF EMBODIMENTS

An example of a container relating to an embodiment of the present disclosure is described in accordance with FIG. 1 through FIG. 10.

The matters presented herein are for exemplary explanation of an embodiment of the present disclosure, and are written for the purpose of presenting what is thought to be a description in which the principles and conceptual features of the present disclosure can be understood most effectively and without difficulty. In this respect, the present disclosure is not intended to illustrate structural details that are of greater than the extent needed for basic understanding of the present disclosure, and, from the following explanation in conjunction with the drawings, it will be clear to those skilled in the art how several forms of the present disclosure can actually be embodied.

(Container 10)

Figure 8:
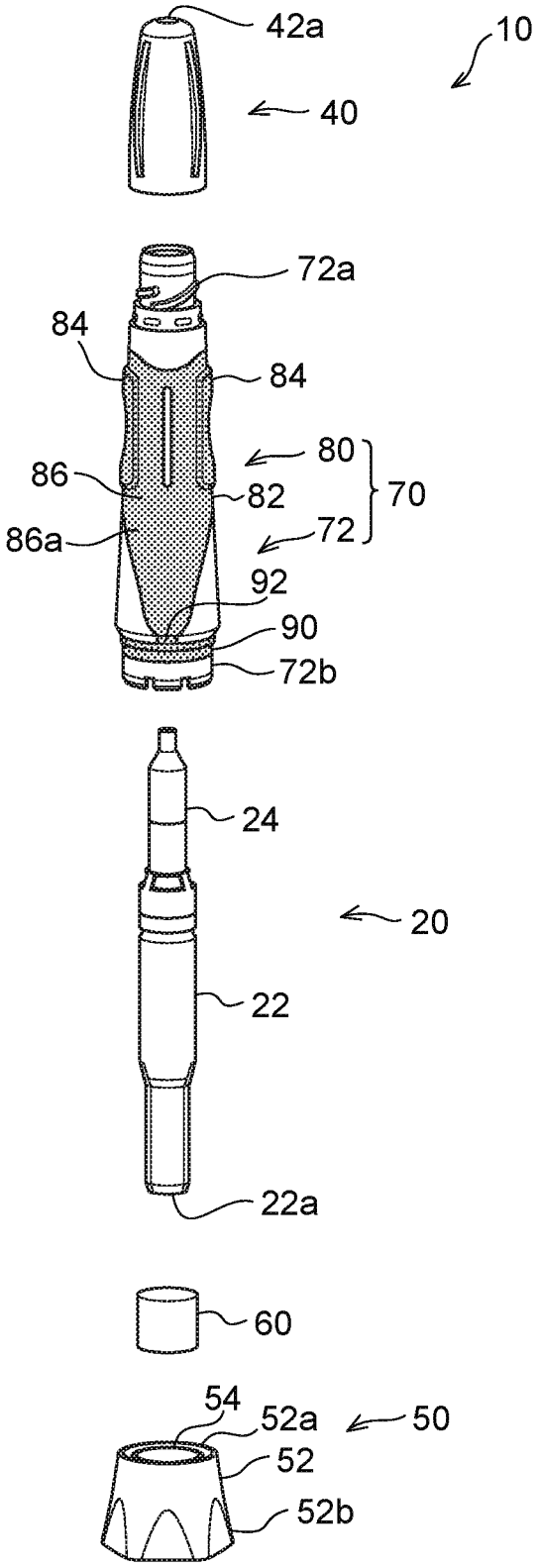
FIG. 8 is an exploded perspective view of the container relating to the embodiment of the present disclosure.

As illustrated in FIG. 8, a container 10 relating to the present embodiment has an inner container 20 in which contents are filled, and an outer container 70 that contains and protects the inner container 20. A cap 40 and a base 50 are attached to the outer container 70. Further, a drying agent 60 is accommodated within the base 50.

(Inner Container 20)

Figure 1:
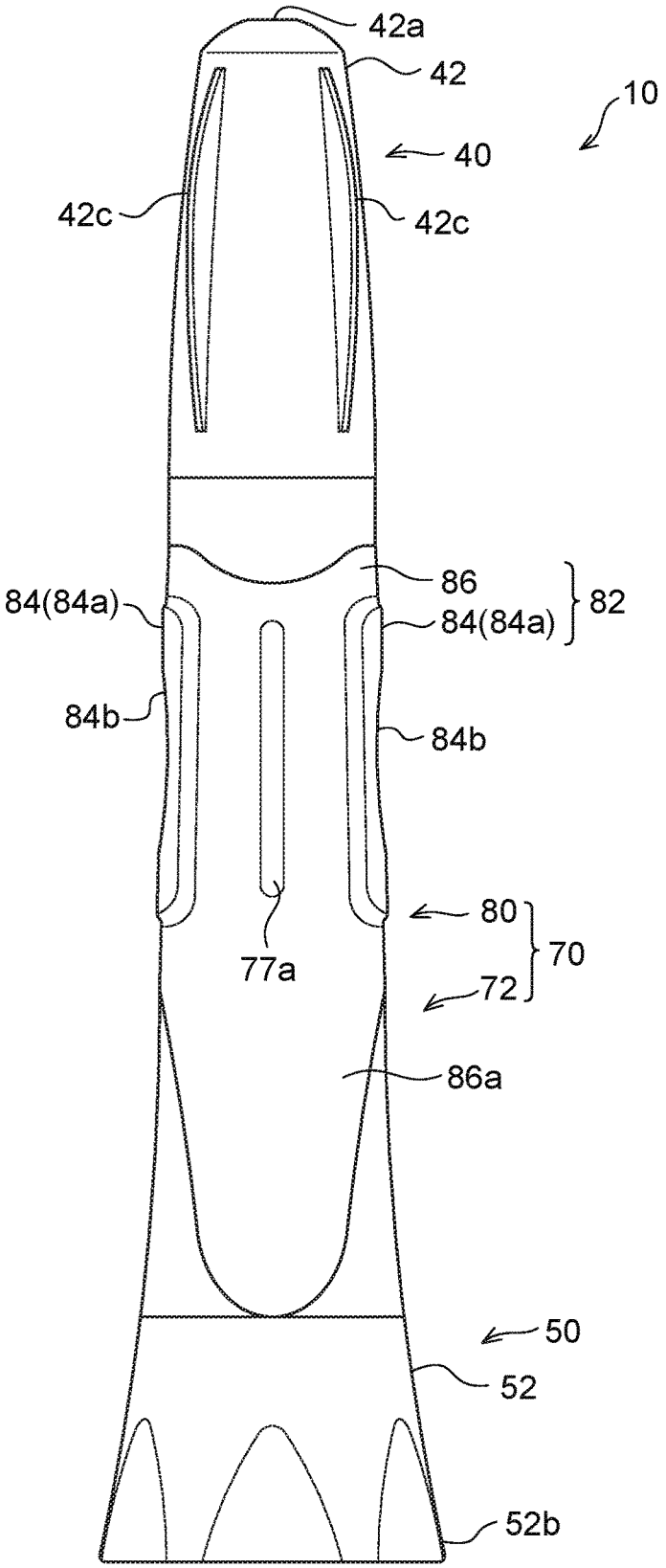
FIG. 1 is a front view of a container relating to an embodiment of the present disclosure.
Figure 2:
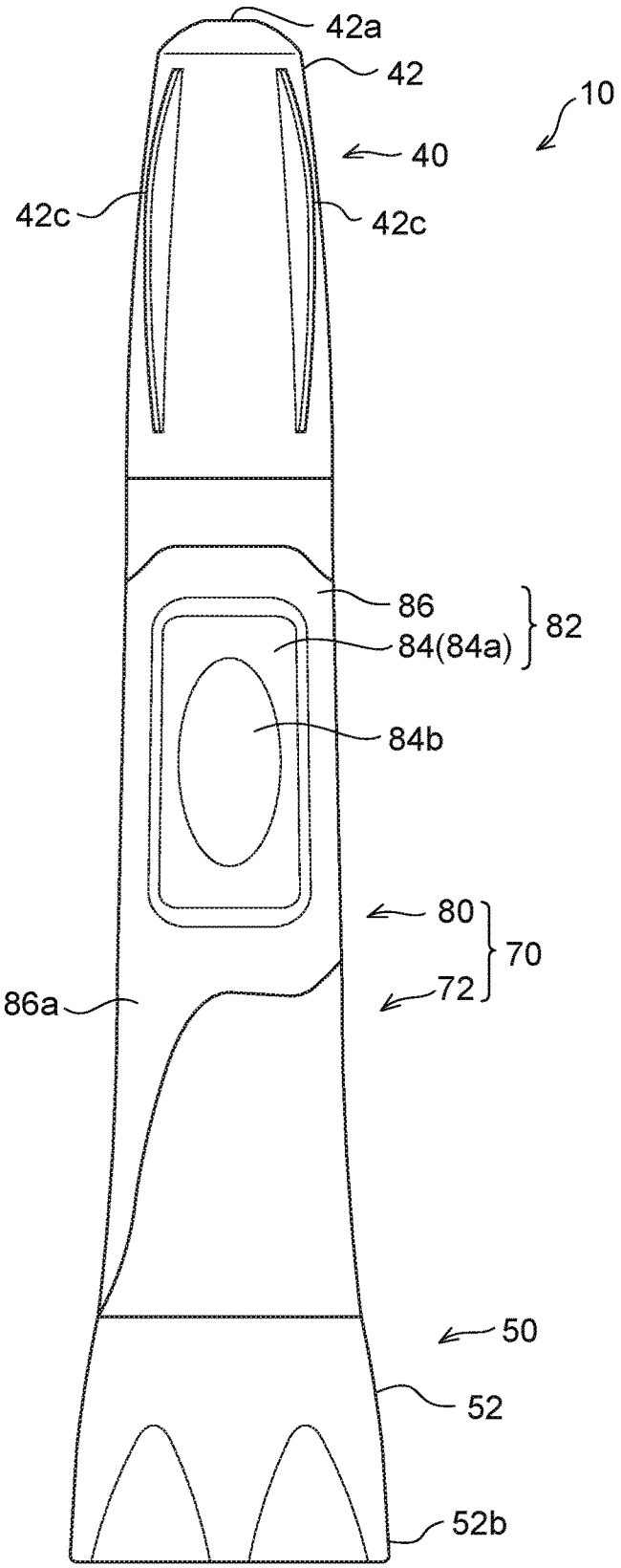
FIG. 2 is a side view of the container relating to the embodiment of the present disclosure.
Figure 3:
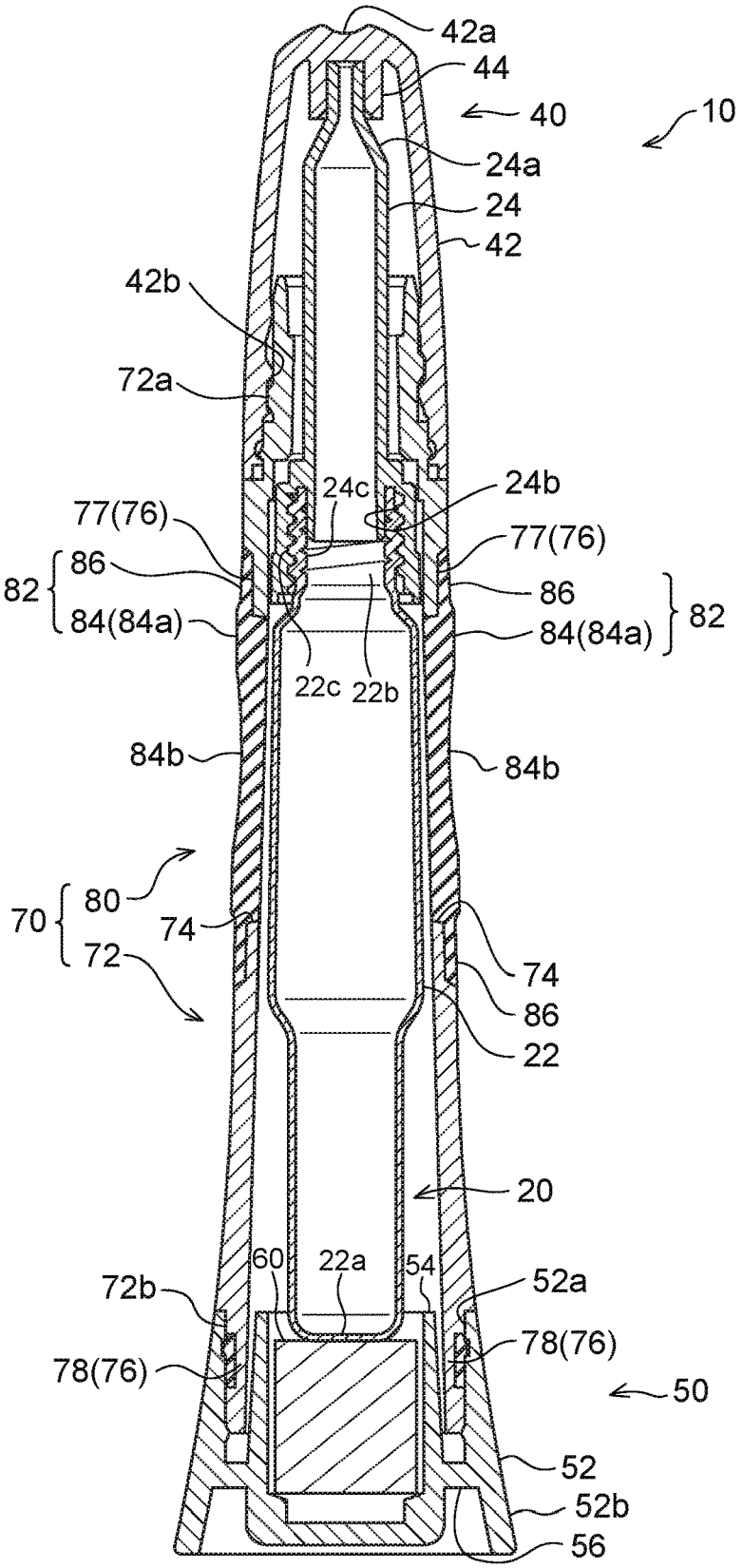
FIG. 3 is a front sectional view of the container relating to the embodiment of the present disclosure.
Figure 4:
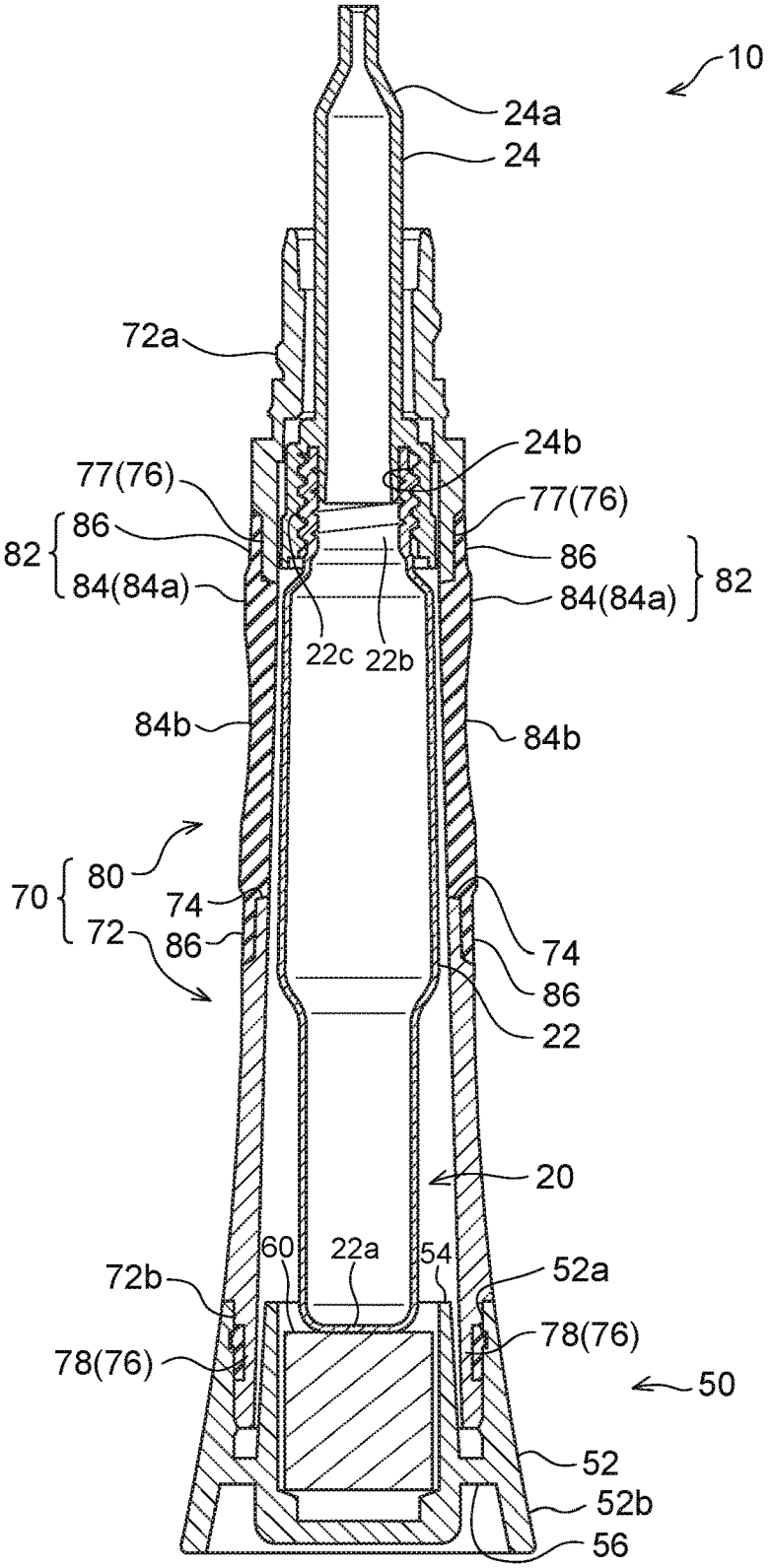
FIG. 4 is a front sectional view, in a state in which a cap is removed, of the container relating to the embodiment of the present disclosure.
Figure 5:
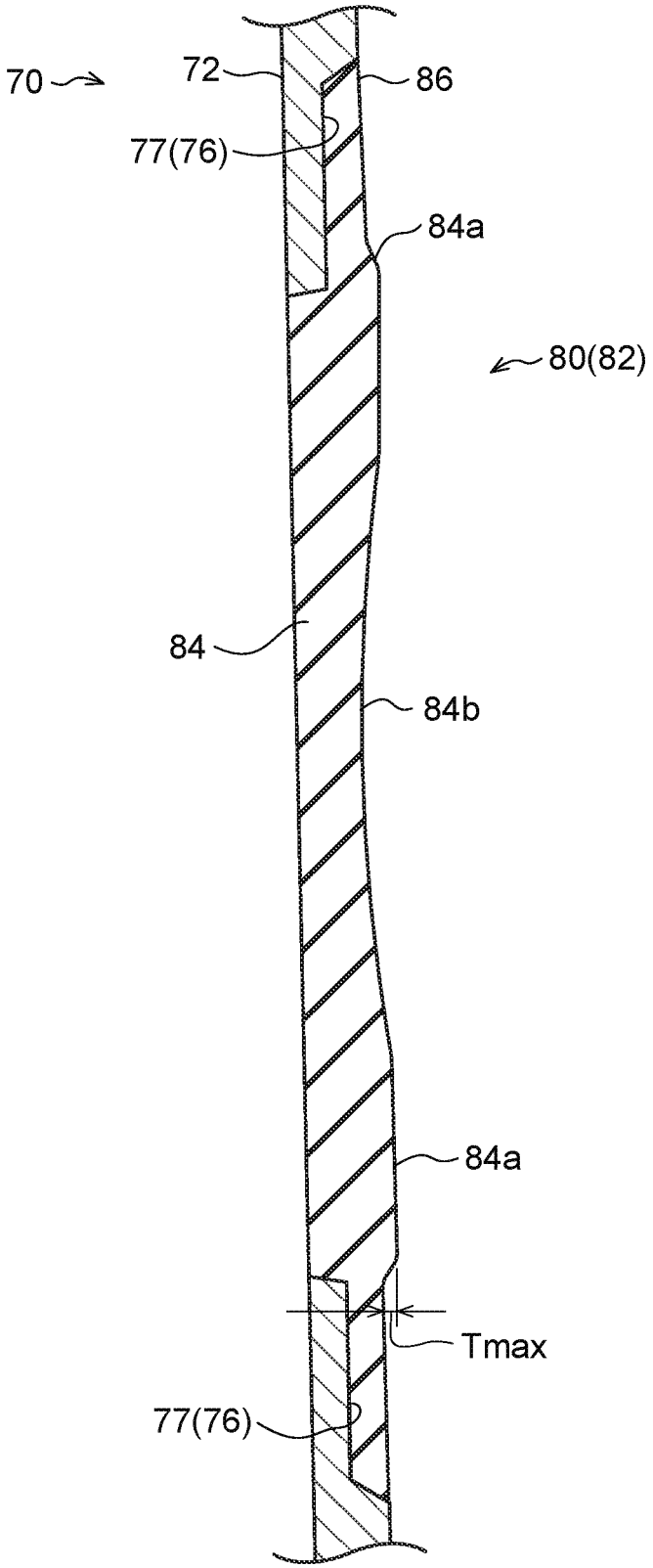
FIG. 5 is a front sectional view in which the periphery of a pressing portion of the container relating to the embodiment of the present disclosure is enlarged.
Figure 6:
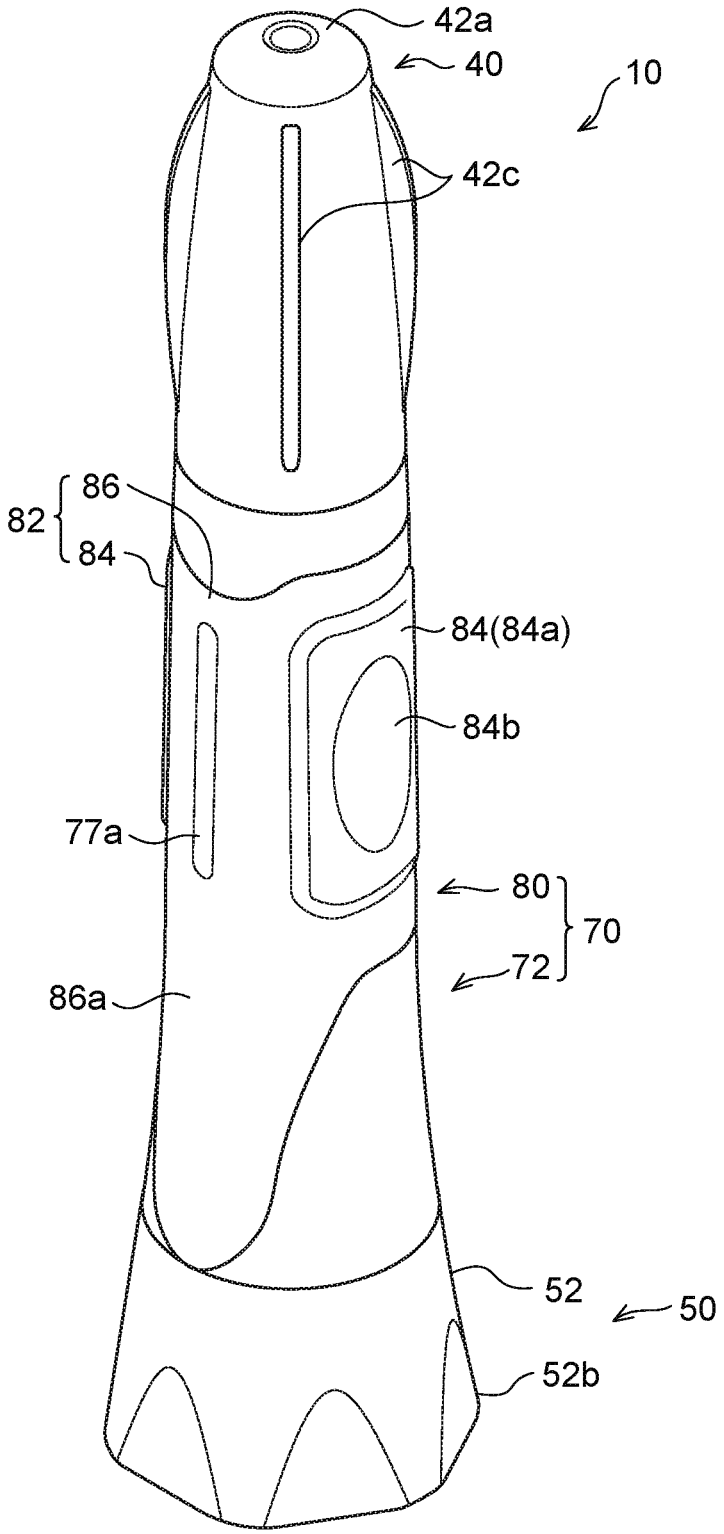
FIG. 6 is a perspective view of the container relating to the embodiment of the present disclosure.

The inner container 20 has a main body portion 22 and a nozzle portion 24. As illustrated in FIG. 3, FIG. 4 and FIG. 8, the main body portion 22 is a member that is shaped as a cylindrical tube having a bottom and that extends in one direction. The main body portion 22 is flexible. The main body portion 22 has a bottom 22*a*, and an opening 22*b* formed in the end portion that is at the side opposite the bottom 22*a*. Further, a male screw portion 22*c* is formed at the outer peripheral wall of the opening 22*b* side end portion of the main body portion 22.

An adhesive, which is in the form of a liquid, a paste, or a jelly and that serves as the contents, is filled in the inner side of the main body portion 22. Specific examples of the adhesive are 2-cyanoacrylate adhesives, epoxy resin adhesives, rubber adhesives, urethane resin adhesives and silicone resin adhesives.

Note that the contents that are filled in the main body portion 22 of the inner container 20 in the present disclosure are not limited to an adhesive, and further, the property thereof also is not limited to a liquid form, a paste form or a jelly form. The contents in the present disclosure may be, for example, a chemical such as a curing agent, a coating agent, shoe polish, wax or the like, a foodstuff such as Japanese horseradish, ginger, mustard, garlic, chocolate, or the like, an everyday good such as toothpaste, makeup, hair dye or the like, a pharmaceutical product such a soft ointment or the like, a stationery product such as paint or the like, or the like.

(Nozzle Portion 24)

The nozzle portion 24 is provided at the opening 22*b* side end portion of the main body portion 22, and is a member that is substantially shaped as a cylindrical tube and that extends in one direction and whose both end portions open in the length direction. At the nozzle portion 24, the diameter of a distal end portion 24*a* at the side opposite the opening 22*b* of the main body portion 22 narrows in a tapered shape. The nozzle portion 24 has, at the end portion that is at the opening 22*b* side of the main body portion 22, an enlarged diameter portion 24*b* that is a peripheral wall and whose diameter is larger than that of the peripheral wall of the other portions of the nozzle portion 24. A female screw portion 24*c* corresponding to the male screw portion 22*c* of the main body portion 22 is formed in the inner peripheral wall of the enlarged diameter portion 24*b* at the nozzle portion 24. Due to the female screw portion 24*c* being screwed and fixed with the male screw portion 22*c*, the nozzle portion 24 is connected to the main body portion 22.

The main body portion 22 of the inner container 20 is flexible. Due thereto, due to the peripheral wall of the main body portion 22 being pressed, the contents such as an adhesive or the like that are filled in the main body portion 22 are expelled out from the opening that is at the distal end portion 24*a* side of the nozzle portion 24.

The inner container 20 is preferably formed of a material that is inert with respect to the adhesive and is not permeable or transmissive with respect to the adhesive. Specifically, the inner container 20 is preferably formed of, for example, a polyolefin resin such as polyethylene, polypropylene, ethylene-vinyl acetate copolymer resin, ethylene-vinyl alcohol copolymer resin or the like, or nylon or polyethylene terephthalate, and is more preferably formed of a polyolefin resin. Namely, it is more preferable that the inner container 20 is a polyolefin resin. Note that the material that forms the inner container 20 relating to the present disclosure is not particularly limited, and may be a material such as a metal such as aluminum, tin, lead or the like.

(Outer Container 70)

Figure 9:
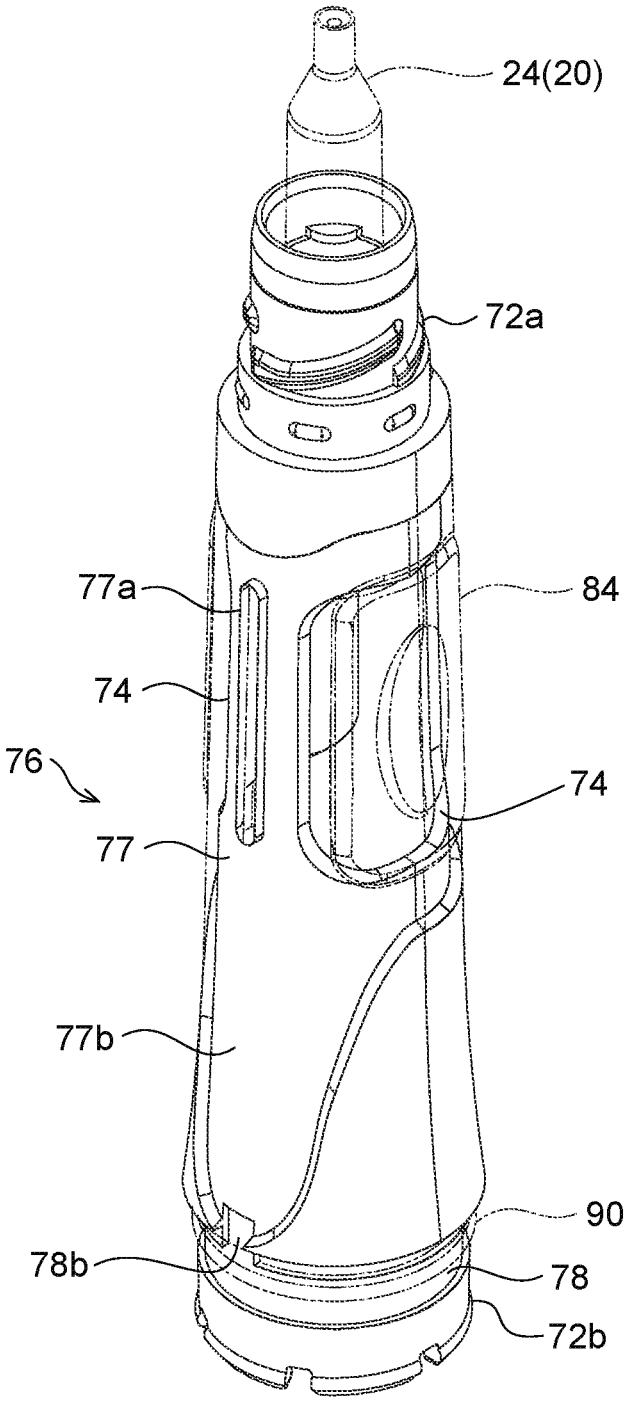
FIG. 9 is a perspective view of an outer container relating to the embodiment of the present disclosure.
Figure 10:
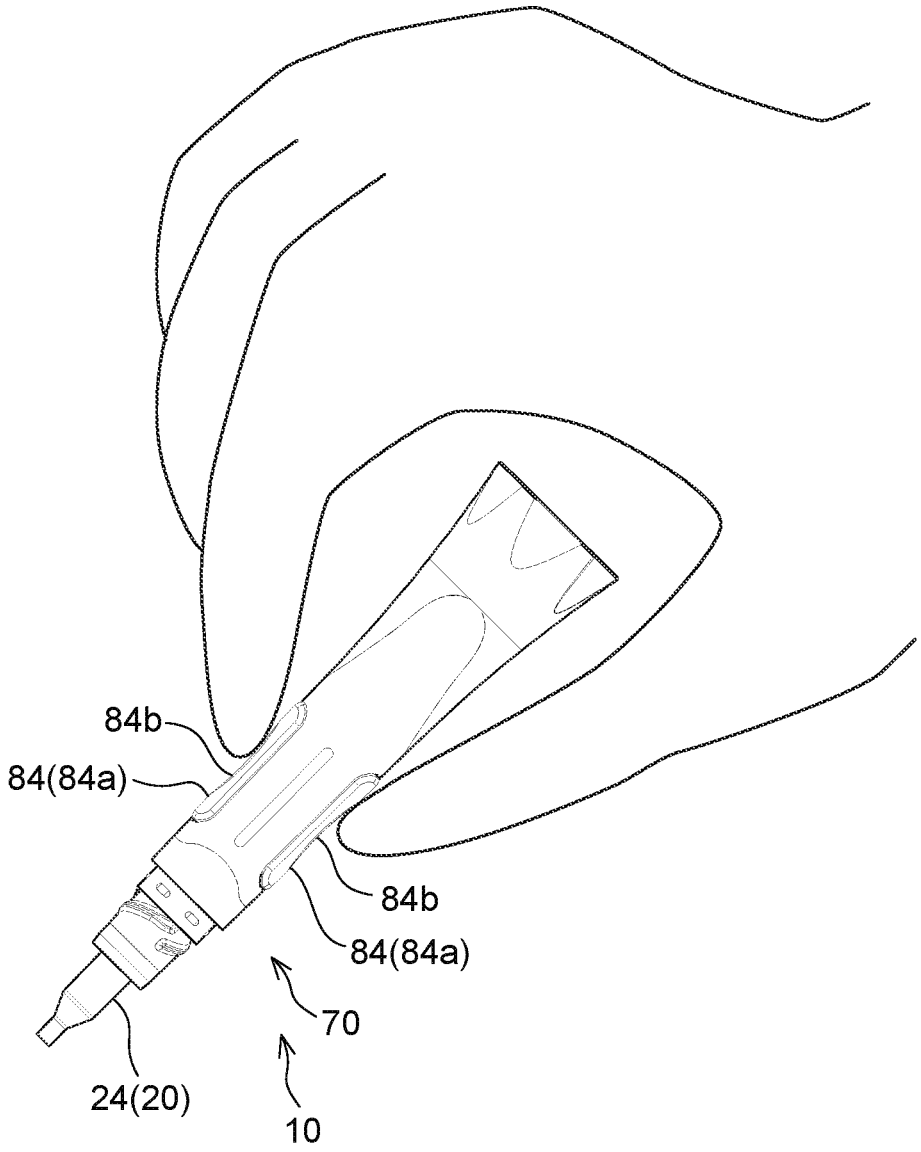
FIG. 10 is a schematic drawing in which the outer container relating to the embodiment of the present disclosure is pinched by a thumb and index finger.

As illustrated in FIG. 9, the outer container 70 is a member that contains the inner container 20 in a state in which the distal end of the nozzle portion 24 projects-out. The outer container 70 has a main body portion 72 and an elastomer portion 80.

(Main Body Portion 72)

The main body portion 72 is a member that is substantially shaped as a cylindrical tube and that extends in one direction and whose both end portions open in the length direction. The diameter of the outer peripheral wall of the main body portion 72 increases in a tapered shape from the end portion at the nozzle portion 24 side of the inner container 20 toward the end portion at the side opposite the nozzle portion 24. As illustrated in FIG. 8, the inner container 20 is inserted into the inner side of the main body portion 72 from the opening that is at the side opposite the side at which the distal end of the nozzle portion 24 of the inner container 20 projects. Further, as illustrated in FIG. 3 and FIG. 4, the main body portion 72 has a structure that is such that it can be fit-together with the outer diameter portion of the enlarged diameter portion 24*b* of the inner container 20, such that the distal end of the nozzle portion 24 of the inner container 20 that is inserted in the main body portion 72 projects-out.

At the main body portion 72, a male screw portion 72*a* is formed at the outer peripheral wall of the end portion that is at the nozzle portion 24 side of the inner container 20. Further, a fit-together portion 72*b*, which has a structure such that it can be fit-together with the inner wall of the outer peripheral wall of the base 50 that is described later, is formed at the end portion of the main body portion 72 which end portion is at the side opposite the side where the distal end of the nozzle portion 24 of the inner container 20 projects-out.

As illustrated in FIG. 3, FIG. 4 and FIG. 9, as seen from the radial direction of the main body portion 72, opening portions 74, which pass-through the outer peripheral wall of the main body portion 72 in substantially rectangular shapes, are formed in the outer peripheral wall at a region overlapping the region that is further toward the bottom side than the male screw portion 22*c* of the main body portion 22 of the inner container 20. The opening portions 74 are rectangular as seen from the radial direction of the main body portion 72, and are formed in the outer peripheral wall of the main body portion 72 as a pair at positions that are axially symmetrical with respect to the central axis of the main body portion 72. Namely, the pair of the opening portions 74 are provided in the outer peripheral wall of the outer container 70, so as to have axial symmetry with respect to the central axis of the outer container 70.

As illustrated in FIG. 9, a covered portion 76, which is concave with respect to the outer peripheral wall of the main body portion 72 and is a region covered by the elastomer portion 80 that is described later, is formed at that outer peripheral wall at least at the peripheries of the opening portions 74. The covered portion 76 has a first covered portion 77 formed between the male screw portion 72*a* and the fit-together portion 72*b*, and a second covered portion 78 formed at the fit-together portion 72*b*.

The first covered portion 77 is formed at the peripheries of the pair of opening portions 74, as if wound on the outer peripheral wall of the main body portion 72 in the peripheral direction. In other words, the opening portions 74 are positioned between the both side edge portions of the first covered portion 77 in the axial direction of the main body portion 72. Further, a pair of rib portions 77*a*, which extend along the axial direction and stand in the radial direction so as to be flush with the outer peripheral wall of the main body portion 72, are formed at portions of the regions, which are located between the pair of opening portions 74 in the peripheral direction, of the first covered portion 77. Further, the first covered portion 77 has a first extending groove 77*b* that is groove-shaped and extends along the axial direction of the outer container toward the fit-together portion 72*b* and is connected to the second covered portion 78.

The second covered portion 78 is formed as if a portion of the peripheral wall of the fit-together portion 72*b* is wound in an annular form in the peripheral direction on the outer peripheral wall of the other portion of the fit-together portion 72*b*. Further, the second covered portion 78 has a second extending groove 78*b* that is groove-shaped and extends along the axial direction of the outer container 70 toward the first extending groove 77*b* of the first covered portion 77 and bites into the first extending groove 77*b*.

The main body portion 72 is formed of a hard resin. The hard resin that forms the main body portion 72 is inert with respect to the adhesive, and a synthetic resin that is not permeable or transmissive with respect to the adhesive is preferable. Specifically, the hard resin that forms the main body portion 72 is preferably a polyolefin resin such as polyethylene, polypropylene, ethylene-vinyl acetate copolymer resin, ethylene-vinyl alcohol copolymer resin or the like, or nylon or polyethylene terephthalate, and a polyolefin resin is more preferable.

At the outer peripheral wall of the main body portion 72, the region that overlaps the main body portion 22 of the inner container 20 as seen from the radial direction preferably has a maximum thickness that is within the range of greater than or equal to 1.0 mm and less than or equal to 2.0 mm. Further, the maximum thickness of this region is more preferably within the range of greater than or equal to 1.2 mm and less than or equal to 1.8 mm. In the present embodiment, the maximum thickness of this region is 1.5 mm.

Note that details of the elastomer portion 80 are described later.

(Cap 40)

As illustrated in FIGS. 1 through 3 and FIG. 6 and FIG. 8, the cap 40 is detachably provided at the end portion of the outer container 70 which end portion is the side where the nozzle portion 24 of the inner container 20 projects-out. Further, the cap 40 is a tubular member that covers the nozzle portion 24 of the inner container 20 that projects-out from the outer container 70. The cap 40 has an outer tube portion 42 and an inner tube portion 44.

The outer tube portion 42 is a tubular region whose one end portion is closed and whose another end portion is open. The closed region of the outer tube portion 42 is a peak portion 42*a*. A female screw portion 42*b*, which corresponds to the male screw portion 72*a* of the outer container 70, is formed at the inner peripheral portion of the opening side of the outer tube portion 42. The cap 40 is attached to the outer container 70 due to the female screw portion 42*b* of the outer tube portion 42 being screwed and fastened to the male screw portion 72*a* of the outer container 70. The diameter of the outer tube portion 42 increases in a tapered shape from the peak portion 42*a* toward the opening. When the cap 40 is attached to the outer container 70, the wall surface of the outer peripheral portion of the outer tube portion 42 is substantially flush along the wall surface of the outer peripheral wall of the outer container 70.

Plural ribs 42*c*, which stand in the radial direction from the outer peripheral portion of the outer tube portion 42 and extend along the axial direction of the outer tube portion 42, are formed at the outer tube portion 42. Specifically, four of the ribs 42*c* are formed at the outer tube portion 42 so as to have axial symmetry with respect to the central axis of the outer tube portion 42.

The inner tube portion 44 is a tubular region that stands from the inner wall of the peak portion 42*a* of the outer tube portion 42 toward the opening of the outer tube portion 42. The end portion of the inner tube portion 44 at the opening side of the outer tube portion 42 is open. When the cap 40 is attached to the outer container 70, the inner tube portion 44 is fit together with the outer peripheral wall of the distal end portion 24*a* of the nozzle portion 24 of the inner container 20, and accommodates the distal end portion 24*a* at the inner side.

The cap 40 is formed of a hard resin. The hard resin that forms the cap 40 is inert with respect to the adhesive, and a synthetic resin that is not permeable or transmissive with respect to the adhesive is preferable. Specifically, the hard resin that forms the cap 40 is preferably a polyolefin resin such as polyethylene, polypropylene, ethylene-vinyl acetate copolymer resin, ethylene-vinyl alcohol copolymer resin or the like, or nylon or polyethylene terephthalate, and a polyolefin resin is more preferable.

(Base 50)

As illustrated in FIGS. 1 through 3 and FIG. 6 and FIG. 8, the base 50 is a tubular member that is detachably provided at the fit-together portion 72*b* of the outer container 70. The base 50 has an outer tube portion 52, an inner tube portion 54 and a connecting portion 56.

The outer tube portion 52 is a tubular region whose both side end portions are open. One end portion of the outer tube portion 52 is a fit-together portion 52*a* that is attached to the outer container 70 due to the inner peripheral wall of that end portion fitting together with the outer peripheral wall of the fit-together portion 72*b* of the outer container 70. The end portion at the opposite side of the fit-together portion 52*a* of the outer tube portion 52 is a leg portion 52*b*. The end surface of the leg portion 52*b* of the outer tube portion 52 that is attached to the outer container 70 is orthogonal to the central axis of the outer container 70. The diameter of the outer peripheral portion of the outer tube portion 52 increases from the fit-together portion 52*a* side toward the leg portion 52*b* side. When the base 50 is attached to the outer container 70, the wall surface of the outer peripheral portion of the outer tube portion 52 is substantially flush along the wall surface of the outer peripheral wall of the outer container 70.

The inner tube portion 54 is disposed at the inner side of the outer tube portion 52, and is a region that is shaped as a cylindrical tube having a bottom whose fit-together portion 52*a* side end portion is open. The connecting portion 56 connects the outer tube portion 52 and the inner tube portion 54, and is a region that partitions the space located between the outer tube portion 52 and the inner tube portion 54 such that air does not pass through between the fit-together portion 52*a* side and the leg portion 52*b* side.

The base 50 is formed of a hard resin. The hard resin that forms the base 50 is inert with respect to the adhesive, and a synthetic resin that is not permeable or transmissive with respect to the adhesive is preferable. Specifically, the hard resin that forms the base 50 is preferably a polyolefin resin such as polyethylene, polypropylene, ethylene-vinyl acetate copolymer resin, ethylene-vinyl alcohol copolymer resin or the like, or nylon or polyethylene terephthalate, and a polyolefin resin is preferable.

When the base 50 and the cap 40 are attached to the outer container 70, the internal space of the container 10 is in a sealed state. Namely, when the base 50 and the cap 40 are attached to the outer container 70, the container 10 has an air barrier property.

(Drying Agent 60)

The drying agent 60 is a member that is cylindrical and is accommodated in the inner side of the inner tube portion 54 of the base 50. The drying agent 60 absorbs moisture contained in the air within the space surrounded by the outer container 70, the cap 40 and the base 50. Namely, the drying agent 60 absorbs moisture that is contained in the air in the internal space of the container 10.

(Elastomer Portion 80)

As illustrated in FIGS. 1 through 4 and FIG. 8 and FIG. 9, the elastomer portion 80 is a member that is made of an elastomer, and is provided at the outer peripheral wall of the main body portion 72 and covers the covered portion 76. The elastomer portion 80 has a first elastomer portion 82 covering the first covered portion 77, and a second elastomer portion 90 covering the second covered portion 78.

(First Elastomer Portion 82)

The first elastomer portion 82 is provided so as to cover the first covered portion 77 of the main body portion 72, and is formed as if wound on the outer peripheral wall of the main body portion 72 in the peripheral direction. The first elastomer portion 82 has pressing portions 84 and a connecting portion 86. The region, which is other than the pressing portions 84, of the first elastomer portion 82 is formed so as to be substantially flush with the outer peripheral wall of the main body portion 72.

(Pressing Portions 84)

The pressing portions 84 are the regions of the first elastomer portion 82 which regions cover the opening portions 74 of the main body portion 72. The pressing portions 84 are formed as a pair so as to correspond to the pair of opening portions 74. The pressing portion 84 has a bulging portion 84*a* and a concave portion 84*b*.

As illustrated in FIG. 1, FIG. 2 and FIGS. 5 through 9, the bulging portion 84*a* is the region at the pressing portion 84 which region bulges out further than the outer peripheral wall of the main body portion 72 and is substantially rectangular as seen from the radial direction of the main body portion 72. Maximum thickness $T_{max}$ of the bulging portion 84*a* in the radial direction of the main body portion 72 is preferably within the range of greater than or equal to 0.2 mm and less than or equal to 1.0 mm. Further, the maximum thickness $T_{max}$ of the bulging portion 84*a* is more preferably within the range of greater than or equal to 0.3 mm and less than or equal to 0.5 mm. In the present embodiment, the maximum thickness $T_{max}$ of the bulging portion 84*a* in the radial direction is 0.35 mm.

The concave portion 84*b* is formed at the central portion of the surface of the bulging portion 84*a*, and is a depression that is concave with respect to the bulging portion 84*a* and is oval as seen from the radial direction. The maximum depth of the concave portion 84*b* is preferably within the range of greater than or equal to 0.2 mm and less than or equal to 0.8 mm. Further, the maximum depth of the concave portion 84*b* is more preferably within the range of greater than or equal to 0.4 mm and less than or equal to 0.6 mm. In the present embodiment, the maximum depth of the concave portion 84*b* is 0.5 mm.

The pressing portions 84 are formed such that the regions, which are at the side of the inner peripheral wall of the main body portion 72, thereof are substantially flush with the inner peripheral wall of the main body portion 72. Further, the pressing portions 84 can press the outer peripheral wall of the main body portion 22 by being pressed in the radial direction from the outer peripheral side and elastically deforming, and reaching the main body portion 22 of the inner container 20.

(Connecting Portion 86)

The connecting portion 86 is the region at the first elastomer portion 82 which region integrally connects the pair of pressing portions 84 as if wound in the peripheral direction on the first covered portion 77 of the outer peripheral wall of the main body portion 72. The connecting portion 86 is formed along the first covered portion 77. The connecting portion 86 has a first extending portion 86*a* that is formed in the first extending groove 77*b* of the first covered portion 77. The first extending portion 86*a* extends along the first extending groove 77*b* toward the fit-together portion 72*b*, and is connected to the second elastomer portion 90. Namely, the first extending portion 86*a* of the connecting portion 86 extends toward the base 50 that is fit-together with the fit-together portion 72*b*. The first extending portion 86*a* is an example of the extending portion.

(Second Elastomer Portion 90)

The second elastomer portion 90 is provided so as to cover the second covered portion 78 of the fit-together portion 72*b*, and is formed as if wound in the peripheral direction on the second covered portion 78 of the outer peripheral wall of the fit-together portion 72*b*. The second elastomer portion 90 has a second extending portion 92 that is formed in the second extending groove 78*b* of the fit-together portion 72*b*, and integrally connects the second elastomer portion 90 with the first extending portion 86*a* of the first elastomer portion 82. The second elastomer portion 90 is formed so as to be substantially flush with the outer peripheral wall of the fit-together portion 72*b*.

(Regarding the Material of the Elastomer Portion 80)

The elastomer that forms the elastomer portion 80 preferably combines flexibility (A hardness), air barrier property (water vapor permeability, oxygen permeability), moldability, and fusibility. Specifically, the elastomer is preferably elastomer composition X that contains isobutylene block copolymer A, which is structured from isobutylene polymer blocks and aromatic vinyl polymer blocks, and medium/low-pressure polyethylene resin B. The elastomer portion 80 in the present embodiment is formed of above-described elastomer composition X.

The isobutylene polymer block is a block containing a structural unit (hereinafter also called isobutylene compound unit) that is derived from an isobutylene compound.

From the standpoint of the water vapor barrier property at high temperatures, the content of the isobutylene compound unit in the entire structural unit that structures the isobutylene polymer block is preferably greater than or equal to 50 mass %, and more preferably greater than or equal to 60 mass %, and even more preferably greater than or equal to 70 mass %.

The isobutylene polymer block may contain a structural unit derived from a monomer other than isobutylene, within a range in which the effects of the present disclosure are not deteriorated. Examples of other monomers are aliphatic olefins, alicyclic olefins, aromatic vinyls, dienes, vinyl ethers, vinyl silanes, vinyl carbazoles, β-pinene, acenaphthylene, and the like.

The content of the isobutylene polymer block within isobutylene block copolymer A is preferably 50~90 mass %, and more preferably 55~85 mass %, and even more preferably 60~80 mass %.

The aromatic vinyl polymer block contains a structural unit (hereinafter also called aromatic vinyl compound unit) derived from an aromatic vinyl compound. Examples of the aromatic vinyl compound are styrene, α-methylstyrene, o-methylstyrene, m-methylstyrene, p-methylstyrene, 1,3-dimethylstyrene, vinyl naphthalene, and the like, and two or more types of these may be used together. Thereamong, styrene that is easy to procure is preferable.

The content of the aromatic vinyl compound unit in the entire structural unit that structures the aromatic vinyl polymer block is preferably greater than or equal to 80 mass %, and more preferably greater than or equal to 90 mass %, and even more preferably greater than or equal to 95 mass %.

The aromatic vinyl polymer block may contain a structural unit derived from a monomer other than an aromatic vinyl compound, within a range in which the effects of the present disclosure are not deteriorated. Examples of other monomers are copolymerizable monomers that can ion-polymerize such as butene, pentene, hexene, butadiene, isoprene, methyl vinyl ether or the like, and the like.

From the standpoint of moldability, the content of the aromatic vinyl polymer block within isobutylene block copolymer A is preferably 10~60 mass %, and more preferably 15~50 mass %, and more preferably 20~40 mass %.

The weight average molecular weight of isobutylene block copolymer A is preferably greater than or equal to 10,000 from the standpoint of the air barrier property, and is preferably less than or equal to 300,000 from the standpoints of flexibility and moldability. From these standpoints, the weight average molecular weight of isobutylene block copolymer A is preferably 10,000~300,000, and more preferably 20,000~200,000, and even more preferably 30,000~100.000.

The A hardness of isobutylene block copolymer A is preferably 10~50, and more preferably 15~45, and even more preferably 20~40.

The density of isobutylene block copolymer A is preferably 0.920~0.970 g/cm$^3$, and more preferably 0.930~0.960 g/cm$^3$, and even more preferably 0.940~0.950 g/cm$^3$.

The content of the isobutylene block copolymer A in the elastomer composition X is preferably 25~99 mass %, and more preferably 25~98 mass %, and even more preferably 50~95 mass %.

From the standpoint of fusibility, the elastomer composition that is used at the container of the present disclosure preferably contains a polyethylene resin. Polyethylene resins are broadly classified into medium/low-pressure polyethylene resins and high-pressure polyethylene resins, due to the difference in the manufacturing methods thereof. Straight-chain high-density polyethylene resins (HDPE) are obtained by medium/low-pressure methods. Low-density polyethylene resins (LDPE) having long chain branches are obtained by high-pressure methods. High-density polyethylene resins have a good air barrier property, and low-density polyethylene resins have a poor air barrier property. Further, in recent years, straight-chain low-density polyethylene resins (L-LDPE) also have become known as a third type of polyethylene resins that are manufactured by medium-pressure methods, and the air barrier property thereof is better than that of high-pressure polyethylene resins. Accordingly, as the medium/low-pressure polyethylene resin in the present disclosure, at least either of high-density polyethylene resins and straight-chain low-density polyethylene resins are preferable, and high-density polyethylene resins are more preferable.

The high-density polyethylene resin is manufactured by a method of polymerizing ethylene at a temperature of 50~250° C. by applying 50~200 atm, and by using a Ziegler catalyst (titanium based) in a low-pressure method or a Philips catalyst (chrome based) or the like in a medium-pressure method.

From the standpoint of the air barrier property, the density of the high-density polyethylene resin is preferably greater than or equal to 0.942 g/cm$^3$, and more preferably 0.945~0.970 g/cm$^3$.

From the standpoint of the air barrier property, the density of the straight-chain low-density polyethylene resin is preferably 0.915~0.935 g/cm$^3$, and more preferably 0.918~0.930 g/cm$^3$.

High-density polyethylene resins (HDPE) and low-density polyethylene resins (LDPE) are homopolyethylene polymers, whereas straight-chain low-density polyethylene resins (L-LDPE) are copolymers of ethylene and α-olefin. Examples of this α-olefin are propylene, 1-butene, 1-pentene, 1-hexene, 3-methylpentene-1, 1-octene, 1-decene, 4-methylpentene-1, and the like.

The content of the structural unit derived from the α-olefin, within the entire structural unit that structures the straight-chain low-density polyethylene resin, is preferably 4~17 mass %, and more preferably 5~15 mass %.

The straight-chain low-density polyethylene resin is manufactured by copolymerizing ethylene and α-olefin by using a Philips catalyst used in a medium-pressure method. A conventional high-density polyethylene resin is made into a short branched structure by the copolymer component, and the density thereof also is lowered appropriately by using the short chain branching.

Accordingly, the straight-chain low-density polyethylene resin is a polyethylene resin that has better linearity than low-density polyethylene resin (LDPE) manufactured by a conventional high-pressure method, and that has a structure in which there is more branching than in a high-density polyethylene resin. The straight-chain low-density polyethylene resin can be manufactured by applying the manufacturing process of a vapor phase polymerization method using a fluidized bed reactor, a stirred bed reactor, a tubular reactor or the like, and for example, on the basis of the method (a vapor phase polymerization method using a fluidized bed reactor) disclosed in Japanese Patent Applications Laid-Open JP-A Nos. S54-148093 and S54-154488, or the like.

From the standpoint of moldability, the melt mass flow rate (MFR) of medium/low-pressure polyethylene resin B is, at 190° C. and a load of 21.2 N, preferably 0.5~50 g/10 min, and more preferably 1~30 g/10 min, and even more preferably 1.5~25 g/10 min.

The water vapor permeability of the medium/low-pressure polyethylene resin B is preferably less than 2.0 $g/m^2 \cdot 24$ h, and more preferably less than 1.8 $g/m^2 \cdot 24$ h, and even more preferably less than 1.6 $g/m^2 \cdot 24$ h, and still more preferably less than 1.0 $g/m^2 \cdot 24$ h. Here, the water vapor permeability is the water vapor permeability at 40° C. of a sheet-like sample of a thickness of 0.5 mm that is measured in accordance with JIS Z 0208 (cup method).

The oxygen permeability of the medium/low-pressure polyethylene resin B is preferably less than $1.0 \times 10^{-5}$ $mol \cdot m/Pa \cdot s \cdot m^2$, and more preferably less than $0.8 \times 10^{-15}$ $mol \cdot m/Pa \cdot s \cdot m^2$, and even more preferably less than $0.6 \times 10^{-15}$ $mol \cdot m/Pa \cdot s \cdot m^2$. Here, the oxygen permeability is a value measured by the method prescribed in JIS K 7126.

The content of the medium/low-pressure polyethylene resin B with respect to 100 parts by mass of the isobutylene block copolymer A is greater than or equal to 5 parts by mass from the standpoints of moldability and fusibility, and is less than or equal to 300 parts by mass from the standpoint of flexibility. From these standpoints, the content of the medium/low-pressure polyethylene resin B with respect to 100 parts by mass of the isobutylene block copolymer A is 1~100 parts by mass, and preferably 2~70 parts by mass, and more preferably 3~60 parts by mass, and even more preferably 5~30 parts by mass.

Further, from the standpoint of flexibility, the content of the medium/low-pressure polyethylene resin B in the elastomer composition X is preferably 0.5~50 mass %, and more preferably 1~30 mass %, and even more preferably 4~25 mass %.

From the standpoints of flexibility and moldability, elastomer composition X may further contain softening agent C for the rubber. Examples of the softening agent C for the rubber are mineral oils such as paraffin oil, naphthene oil, aromatic oils and the like, and synthetic softening agents such as polyolefin oils of poly α-olefin, polybutene and the like, and the like. Thereamong, from the standpoint of the water vapor barrier property, polyolefin oil is preferable, and polybutene oil is more preferable.

From the standpoints of long-term heat resistance and the air barrier property, the kinematic viscosity at 40° C. of the softening agent C for the rubber is preferably 3,000~20,000 $mm^2/s$, and more preferably 4,000~17,500 $mm^2/s$, and even more preferably 5,000~15,000 $mm^2/s$.

From the standpoints of long-term heat resistance and the air barrier property, the number average molecular weight of the softening agent C for the rubber is preferably 600~2000, and more preferably 800~1500, and even more preferably 900~1200.

Further, from the standpoint of moldability, the content in the elastomer composition X of the softening agent C for the rubber is preferably less than or equal to 50 mass %, and more preferably less than or equal to 30 mass %.

From the standpoint of fusibility to L-LDPE, the elastomer composition X may further contain block copolymer D that has crystalline ethylene blocks and amorphous ethylene·α-olefin blocks.

Examples of the α-olefin are 1-butene, 1-octene, 1-hexene, 4-methylpentene-1, and the like. Thereamong, 1-butene is preferable, and a block copolymer (CEBC) having crystalline ethylene blocks and amorphous ethylene·butene blocks is preferable as the block copolymer D. In the present disclosure, a single block copolymer D may be used, or two or more types of the block copolymer D may be mixed together and used.

Further, there are block copolymers D having a linear structure and block copolymers D having a radial structure, as the joined state of the blocks. Dynaron 6101, Dynaron 6200P (manufactured by JSR Corporation) and the like are examples of commercially available products having a linear structure. Dynaron 6201B (manufactured by JSR Corporation) and the like are examples of commercially available products having a radial structure. In the present disclosure, block copolymers of either of these structures can be used preferably, but, at same weight average molecular weights, a block copolymer of a radial structure that has high melt fluidity is more preferable.

The A hardness of the block copolymer D is preferably greater than or equal to 40 from the standpoint of compatibility with the isobutylene block copolymer A and the medium/low-pressure polyethylene resin B, and is preferably less than or equal to 95 from the standpoint of flexibility of the composition. From these standpoints, the A hardness of the block copolymer D is preferably 40~95, and more preferably 50~90, and even more preferably 60~80.

From the standpoint of compatibility with the isobutylene block copolymer A and the medium/low-pressure polyethylene resin B, the content of the block copolymer D with respect to 100 parts by mass of the isobutylene block copolymer A is preferably greater than or equal to 1 part by mass, and, from the standpoint of flexibility, is preferably less than or equal to 50 parts by mass. From these standpoints, the content of the block copolymer D with respect to 100 parts by mass of the isobutylene block copolymer A is preferably less than or equal to 50 parts by mass, and more preferably less than or equal to 30 parts by mass, and even more preferably less than or equal to 20 parts by mass.

Further, from the standpoint of the water vapor barrier property, the elastomer composition X may contain inorganic filler E.

Examples of the inorganic filler E are talc, mica, calcium carbonate, clay, titanium oxide, magnesium carbonate, barium sulfate, calcium sulfate, calcium sulfite, calcium phosphate, calcium hydroxide, magnesium hydroxide, aluminum hydroxide, magnesium oxide, iron oxide, zinc oxide, alumina, silica, diatomaceous earth, dolomite, gypsum, calcined clay, asbestos, calcium silicate, bentonite, white carbon, carbon black, iron powder, aluminum powder, stone dust, blast furnace slag, fly ash, cement, zirconia powder, and the like. Thereamong, from the standpoints of the water vapor barrier property and dispersibility, talc is preferable.

Inorganic fillers of various shapes, such as granular, plate-shaped, rod-shaped, fibrous, whisker-shaped and the like are known, and, in the present disclosure, from the standpoints of the water vapor barrier property and the air barrier property, plate-shaped inorganic fibers are preferable. Plate-shaped means a shape in which the ratio (length/ thickness) of the length and the thickness is greater than or equal to 5, and is preferably 10~500.

The volume-based median diameter of the inorganic filler E is preferably greater than or equal to 1.5 μm from the standpoint of dispersibility, and is preferably less than or equal to 50 μm from the standpoint of the water vapor barrier property. From these standpoints, the volume-based median diameter of the plate-shaped inorganic filler is preferably 1.5~50 μm, and more preferably 1.75~30 μm, and even more preferably 2.0~15 μm.

From the standpoint of flexibility, the content of the inorganic filler E with respect to 100 parts by mass of the isobutylene block copolymer A is preferably less than or equal to 500 parts by mass. From these standpoints, the content of the inorganic filler E with respect to 100 parts by mass of the isobutylene block copolymer A is preferably less than or equal to 500 parts by mass, and more preferably less than or equal to 500 parts by mass, and even more preferably less than or equal to 300 parts by mass.

Further, as needed and within a range in which the effects of the present disclosure are not deteriorated, the elastomer composition X may contain reinforcing agents such as carbon black, silica, carbon fibers, glass fibers or the like, and various types of additives such as insulating/heat-conducting fillers, pigments, flame retardants, antistatic agents, mold releasing agents, tackifiers, crosslinking agents, crosslinking aids, foaming agents, perfumes, and the like.

Further, the elastomer composition X may contain another thermoplastic resin or thermoplastic elastomer, within a range in which the effects of the present disclosure are not deteriorated.

The elastomer composition X in the present disclosure is obtained by appropriately mixing and hardening the isobutylene block copolymer A and the medium/low-pressure polyethylene resin B. and further, as needed, additives such as the softening agent C for the rubber, the block copolymer D, the inorganic filler E and the like.

What is referred to as "mixing" in the present disclosure is not particularly limited provided that it is a method in which the various materials can be mixed together well, and may be mixing by dissolving the various materials in an organic solvent in which they can be dissolved, or may be mixing by kneading while heating and melting. However, the mixing of the materials is preferably carried out under the condition of a temperature at which the isobutylene block copolymer A and the medium/low-pressure polyethylene resin B melt.

In the case of kneading the various materials while heating and melting, an arbitrary heating/melting kneader can be used. For example, a Banbury mixer, a roll mixer, an extruder or the like can be used, and, from the standpoint of uniform mixing and mass producibility, a dual-shaft extruder is preferably used. The supplying to the extruder may be the providing, from a single hopper, of a mixture of the various components that has been mixed in advance by a mixer such as a Henschel mixer or the like, or may be the providing of the respective components by two hoppers while the components are metered by screws or the like by readying hoppers.

The composition obtained by mixing the materials that structure the elastomer composition X can be made to be in the form of pellets, a powder, a sheet or the like, depending on the application. For example, the materials are melted and kneaded by an extruder, and the mixture is extruded in strands, and, while being cooled in cold water, is cut by a cutter into pellets that are cylindrical or shaped as rice grains or the like. The obtained pellets are usually made into a molded product of a predetermined sheet shape or a die molded product, by injection molding or extrusion molding. Further, the melted and kneaded substance can be made into pellets by a Ruder or the like, and used as a material for molding processing.

From the standpoint of the ease of adjusting the expelled amount of the contents, the A hardness of elastomer composition X relating to the present disclosure is preferably within the range of greater than or equal to 40 and less than 80, and more preferably within the range of greater than or equal to 50 and less than 75, and even more preferably greater than or equal to 60 and less than 70.

From the standpoints of moldability and fusibility, the melt mass flow rate (MFR) of elastomer composition X relating to the present disclosure is, at 190° C. and a load of 21.2 N, preferably greater than or equal to 0.1 g/10 min, and more preferably 1.0~15.0 g/10 min, and even more preferably 1.0~10.0 g/10 min, and still more preferably greater than or equal to 2.0~4.0 g/10 min.

From the standpoint of protection (long-term storage) of the contents, the water vapor permeability of elastomer composition X relating to the present disclosure is preferably less than 2.0 $g/m^2 \cdot 24$ h, and more preferably less than 1.8 $g/m^2 \cdot 24$ h, and even more preferably less than 1.6 $g/m^2 \cdot 24$ h. Here, the water vapor permeability is the water vapor permeability at 40° C. of a sample of a thickness of 0.5 mm that is measured in accordance with JIS Z 0208 (cup method).

From the standpoint of protection (long-term storage) of the container contents, the oxygen permeability of elastomer composition X relating to the present disclosure is preferably less than $1.0\times10^{-15}$ $mol \cdot m/Pa \cdot s \cdot m^2$, and more preferably less than $0.8\times10^{-15}$ $mol \cdot m/Pa \cdot s \cdot m^2$, and even more preferably less than $0.6\times10^{-15}$ $mol \cdot m/Pa \cdot s \cdot m^2$. Here, the oxygen permeability is a value measured by the method prescribed in JIS K 7126.

The outer container 70 relating to the present disclosure is obtained in a state in which the elastomer portion 80 is fused to the main body portion 72, due to the elastomer composition X and the polyolefin resin being molded in two colors.

In the present disclosure, fusing is the phenomenon in which heat of greater than or equal to the fusing point of elastomer composition X is applied, and after the elastomer composition X is turned into a molten liquid, the elastomer composition X is made to be a temperature of less than or equal to the fusing point and hardened, and is thereby fixed to the interface of the object of fixing. A hot press, a heating roller machine, a hot air generator, heating steam, an ultrasonic welder, a high-frequency welder, a laser or the like can be used in applying heat. Accordingly, even if the interface of the fused portion is a complex, solid shape, molding and integration with a good fit to the complex, solid shape is possible.

Accordingly, the elastomer composition X becomes integral with the polyolefin resin, and a composite molded body can be obtained. Due thereto, conjugation of members having complex joined surfaces, and members having joined surfaces of shapes that differ from one another, also is possible. Such a composite molded body can be obtained by molding processing by a method such as injection molding, injection compression molding, insert molding, multicolor molding, vacuum molding, pressure forming, blow molding, hot press molding, foam molding, laser melting molding, extrusion molding, or the like.

EXAMPLES

Specific Examples of composite molded bodies that are structured by the elastomer composition X and the polyolefin resin relating to the present disclosure are described hereinafter. In the Examples and Comparative Examples, the various properties of the materials that are used were measured by the following methods.

<Component A: Isobutylene Block Copolymer, Etc.>

[Composition of Block Copolymer]

By carrying out proton NMR measurement by using a nuclear magnetic resonance device (DPX-400, manufactured by Bruker Corporation of Germany), and carrying out quantitative determination of the characteristic group of the styrene, the content of the styrene and/or styrene derivative, i.e., the content of the aromatic vinyl polymer block, is determined. The contents of the other monomer units also can be determined by proton NMR measurement.

[Weight Average Molecular Weight (Mw)]

The molecular weight is measured by polystyrene conversion by gel permeation chromatography under the following measurement conditions, and the weight average molecular weight is determined.

Measurement Device

- pump: manufactured by Jasco Corporation, PU-980
- column oven: manufactured by Showa Denko Co., Ltd., AO-50
- detector: manufactured by Hitachi, RI (differential refractometer) detector L-3300
- column type: one of each of "K-805L (8.0×300 mm)" and "K-804L (8.0×300 mm)" manufactured by Showa Denko Co., Ltd. are used in series
- column temperature: 40° C.
- guard column: K-G (4.6×10 mm)
- eluent: chloroform
- eluent flow rate: 1.0 ml/min
- concentration of sample: approximately 1 mg/ml
- sample solution filter: disposable filter made of polytetrafluoroethylene and having a pore diameter of 0.45 μm
- reference sample for calibration curve: polystyrene manufactured by Showa Denko Co., Ltd.

[A Hardness]

The A hardness (the value 15 seconds after the start of testing) as prescribed in JIS K6253 is measured at a structure in which three samples of plate-shaped, injection molded bodies of a thickness of 2 mm are layered together (a total of 6 mm). Measurement is carried out after the states of the aforementioned injection molded body samples are adjusted for one day in a room of a temperature of 23° C. and a humidity of 50%.

[Density]

The mass is measured in atmosphere and in water under the condition of 23° C. by using the precise electronic densimeter "SD-200L" manufactured by Alfa Mirage Co., Ltd., and the density is calculated.

<Component B: Polyethylene Resin, Etc.>

[Density]

Mass is measured in atmosphere and in ethanol under the condition of 23° C. by using the precise electronic densimeter "SD-200L" manufactured by Alfa Mirage Co., Ltd., and the density is calculated.

[Melt Mass Flow Rate (MFR)]

The melt mass flow rate is measured under the conditions of 190° C. and a load of 21.2 N in accordance with ASTM D1238.

[Water Vapor Permeability]

The water vapor permeability is measured in accordance with JIS Z 0208 (cup method) by using a water vapor permeation cup (diameter 70 mm) manufactured by Yasuda Seiki Seisaku-sho Co., Ltd., under conditions of 40° C.×90% RH and at a sheet thickness of 0.5 mm.

[Oxygen Permeability]

Oxygen permeability is measured by the method prescribed in JIS K 7126 at 23° C. by using the gas permeability measuring device "BR-3" manufactured by Toyo Seiki Seisaku-sho Co., Ltd. A sample piece of 90 mm×90 mm×0.5 mint and a permeation surface area of 38.5 $cm^2$ is used.

<Component C: Softening Agent for Rubber>

[Kinematic Viscosity]

The kinematic viscosity is measured at a temperature of 40° C. in accordance with JIS Z 8803.

[Number Average Molecular Weight]

The number average molecular weight is determined by polystyrene conversion by a method similar to that used for component A.

<Component D: Block Copolymer having Crystalline Ethylene Blocks and Amorphous Ethylene·α-Olefin Blocks>

[A Hardness]

The A hardness (the value 15 seconds after the start of testing) as prescribed in JIS K6253 is measured at a structure in which three samples of plate-shaped, injection molded bodies of a thickness of 2 mm are layered together (a total of 6 mm). Measurement is carried out after the states of the aforementioned injection molded body samples are adjusted for one day in a room of a temperature of 23° C. and a humidity of 50%.

[Density]

Mass is measured in atmosphere and in ethanol under the temperature condition of 23° C. by using the precise electronic densimeter "SD-200L" manufactured by Alfa Mirage Co., Ltd., and the density is calculated.

<Component E: Inorganic Filler>

[Volume-Based Median Diameter]

The particle size distribution of a slurry, which is obtained by dispersing a 0.1 g sample in 10 mL of deionized water and dispersing for 30 seconds by ultrasonic waves of 70 w, is measured in accordance with the laser diffraction/scattering method prescribed in JIS M8511 by "Mastersizer 2000" manufactured by Malvern Panalytical Ltd. The 50% value in the volume-based cumulative fraction is used as the volume-based median diameter.

(1) Preparation of Elastomer Composition (Pellets)

After the materials other than the softening agent (component C) were dry blended, the softening agent was impregnated therein, and a compound was prepared. Thereafter, under the following conditions, the compound was melted and kneaded by an extruder, and was extruded in strands, and while being cooled in cold water, was cut by a cutter into shapes of a diameter of approximately 3 mm and a thickness of approximately 3 mm, and pellets of the elastomer composition were prepared.

[Melting/Kneading Conditions]

- extruder: KZW32TW-60MG-NH (product name, manufactured by Technovel Corporation)
- cylinder temperature: 180~220° C.
- number of rotations of screw: 300 r/min The details of the materials used in manufacturing the pellets of the elastomer material are shown in following Table 1 through Table 3. Further, pellets of the elastomer compositions of Examples 1 through 7 and Comparative Examples 1 through 5, in which the ratios of the respective materials differed, were manufactured in the manufacturing of pellets of the elastomer compositions. Note that details of the elastomer compositions of Examples 1 through 7 and Comparative Examples 1 through 5 are described hereafter.

TABLE 1

[Component A: Isobutylene Block Copolymer, etc.]

| product name (manufacturer) | composition | content of styrene blocks (mass %) | weight average molecular weight | A hardness | density (g/cm3) |
|---|---|---|---|---|---|
| SIBSTAR 062 (Kaneka Corporation) | SIBS (styrene-isobutylene-styrene triblock copolymer) | 23 | 70,000 | 33 | 0.948 |
| SIBSTAR 102T (Kaneka Corporation) | SIBS (styrene-isobutylene-styrene triblock copolymer) | 15 | 140,000 | 25 | 0.942 |
| Krayton G1843 (Krayton Polymers LLC) | SEBS (styrene-ethylenebutylene-styrene triblock copolymer) | 18 | 140,000 | 52 | 0.9 |
| INFUSE 9007 (Dow Chemical Co.) | ethylene•1-octene copolymer | — | — | 64 | 0.866 |

TABLE 2

[Polyethylene Resin, etc.]

| product name (manufacturer) | composition | density (g/cm3) | MFR (g/10 min) | water vapor permeability ($g/m^2$-24 h) (when thickness is 0.5 mm) | oxygen permeability ($mol/m/Pa \cdot s \cdot m^2$) |
|---|---|---|---|---|---|
| Niporon Hard 1000 (Tosoh Corporation) | HDPE | 0.964 | 20 | 0.2 | $2.2 \times 10^{-15}$ |
| Evolue SP2520 (Prime Polymer Co., Ltd.) | L-LDPE | 0.925 | 2 | 1.4 | $6.0 \times 10^{-15}$ |
| Petrosen 175K (Tosoh Corporation) | LDPE | 0.920 | 0.8 | 1.7 | $7.4 \times 10^{-15}$ |
| PM802A (SunAllomer Ltd.) | homopolypropylene resin | 0.900 | 20 | 1.0 | $3.0 \times 10^{-16}$ |

TABLE 3

| | product name (manufacturer) | composition | properties |
|---|---|---|---|
| component C | HV-100 (ENEOS Corporation) | polybutene oil | kinematic viscosity (40° C.): 9500 $mm^2/s$<br>number average molecular weight: 980 |
| component D | DYNARON 6200P (JSR Corporation) | CEBC | density: 0.88 $g/cm^3$ |
| component E | Talcan Hayashi (Hayashi Kasei Co., Ltd.) | talc | plate-shaped<br>volume-based median diameter: 11 μm |

(2) Preparation of Molded Body of Thermoplastic Elastomer Composition

The pellets of the elastomer compositions of Examples 1 through 7 and Comparative Examples 1 through 5 were injection molded under the following conditions, and plates of thickness 2 mm×width 125 mm×length 125 mm were prepared.

[Injection Molding Conditions]

injection molding machine: 100MSIII-10E (product name, manufactured by Mitsubishi Heavy Industries Ltd.)

injection molding temperature: 200° C.

injection pressure: 30% injection time: 3 sec temperature of mold: 40° C.

(3) Preparation of Composite Molded Body

As the polyolefin resin, pellets of HDPE (Niporon Hard 4020 manufactured by Tosoh Corporation) and L-LDPE (Evolue SP2520 manufactured by Prime Polymer Co., Ltd.) were respectively injection molded under the following conditions, resin plates of thickness 2 mm×width 125 mm×length 125 mm were prepared, the resin plates were cut by a cutter, and fused sample substrates of thickness 2 mm×width 25 mm×length 125 mm were obtained.

[Resin Plate Molding Conditions]

gate: film gate cylinder temperature: 200° C.

measured value: 55 mm hold pressure switch position: 3.8 mm

The prepared resin plate was inserted into a mold of thickness 4 mm×width 25 mm×length 125 mm, and the elastomer composition of Examples 1 through 7 and Comparative Examples 1 through 5 was injection molded, and a strip-shaped composite molded body was prepared.

<Injection Molding Conditions> injection molding machine: 100MSIII-10E manufactured by Mitsubishi Heavy Industries Ltd.

injection molding temperature: 240° C.

injection pressure: 98 MPa, injection speed: 50%, holding pressure: 20%, holding time: 10 sec injection time: 2 sec temperature of mold: 40° C.

The following evaluations were carried out on the elastomer compositions of Examples 1 through 7 and Comparative Examples 1 through 5, and the composite molded bodies using these elastomer compositions. The compositions and the results of evaluation of the elastomer compositions of Examples 1 through 7 and Comparative Examples 1 through 5 are shown in Table 4 and Table 5.

[A Hardness of Elastomer Composition]

The A hardness (the value 15 seconds after the start of testing) as prescribed in JIS K6253 is measured at a structure in which three samples of plate-shaped, injection molded bodies of a thickness of 2 mm are layered together (a total of 6 mm). Measurement is carried out after the states of the aforementioned injection molded body samples are adjusted for one day in a room of a temperature of 23° C. and a humidity of 50%.

[MFR of Elastomer Composition]

The MFR is measured under the conditions of 190° C. and a load of 21.2 N in accordance with ASTM D1238.

[Water Vapor Permeability of Elastomer Composition]

The elastomer composition was placed in a retaining mold for pressing of thickness 0.5 mm width 100 mm×length 120 mm. By using a heat press (Toho Machinery Co., Ltd., hydraulic molding machine TB-50-2) that was heated to 200° C., heat pressing was carried out for two minutes, and then cold pressing was carried out for three minutes, and a sheet-shaped press molded body of a thickness of 0.5 mm was prepared as a sample piece.

The water vapor permeability was measured in accordance with JIS Z 0208 (cup method) by using a water vapor permeation cup (diameter 70 mm) manufactured by Yasuda Seiki Seisaku-sho Co., Ltd., under conditions of 40° C.×90% RH and at a sheet thickness of 0.5 mm.

[Oxygen Permeability of Elastomer Composition]

The elastomer composition was placed in a retaining mold for pressing of thickness 0.5 mm×width 100 mm×length 120 mm. By using a heat press (Toho Machinery Co., Ltd., hydraulic molding machine TB-50-2) that was heated to 200° C., heat pressing was carried out for two minutes, and then cold pressing was carried out for three minutes, and a sheet-shaped press molded body of a thickness of 0.5 mm was prepared as a sample piece. Sample piece dimensions of 90 mm by 90 mm by 0.5 mmt, and a permeation surface area of 38.5 $cm^2$, were used.

The oxygen permeability was measured in accordance with the method prescribed in JIS K 7126 at 23° C. by using the gas permeability measuring device "BR-3" manufactured by Toyo Seiki Seisaku-sho Co., Ltd.

[Fusibility of Composite Molded Body]

By using the composite molded body, a tensile test was carried out in 180° directions at 50 mm/min on the layer of the elastomer composition (the surface material layer) and the layer of the polyolefin resin (the substrate layer) at an ambient temperature of 23° C., and the peel strength (unit: N/25 mm) of the surface material layer and the substrate layer was measured. Greater than or equal to 120 N/25 mm is preferable for the peeling strength.

TABLE 4

| | | | Example 1 | | Example 2 | | Example 3 | | Example 4 | | Example 5 | | Example 6 | | Example 7 | |
|---|---|---|---|---|---|---|---|---|---|---|---|---|---|---|---|---|
| | | | parts | % | parts | % | parts | % | parts | % | parts | % | parts | % | parts | % |
| material | component A | SIBSTAR 062T | 100 | 90 | 100 | 80 | 100 | 70 | 100 | 80 | 100 | 80 | 100 | 62 | 100 | 54 |
| | component B | Niporon Hard 1000 | 11 | 10 | 25 | 20 | 43 | 30 | — | — | 13 | 10 | 25 | 15 | 43 | 23 |
| | | Evolue SP2520 | — | — | — | — | — | — | 25 | 20 | — | — | — | — | — | — |
| | component C | HV-100 | — | — | — | — | — | — | — | — | — | — | — | — | 42.9 | 23 |
| | component D | DYNARON 6200P | — | — | — | — | — | — | — | — | 12.5 | 10 | — | — | — | — |
| | component E | Talcan Hayashi | — | — | — | — | — | — | — | — | — | — | 37.5 | 23 | — | — |
| properties | flexibility | A hardness | 54 | | 67 | | 81 | | 54 | | 56 | | 69 | | 51 | |
| | fluidity | MFR (g/10 min) | 1.5 | | 2.6 | | 3.9 | | 4.8 | | 3.2 | | 1.8 | | 15 | |
| | gas barrier property | water vapor permeability ($g/m^2 \cdot 24$ h) (when thickness is 0.5 mm) | 1.0 | | 0.9 | | 0.8 | | 1.4 | | 1.6 | | 0.9 | | 1.0 | |
| | | oxygen permeability ($mol \cdot m/Pa \cdot s \cdot m^2$) | $3.55 \times 10^{-16}$ | | $3.88 \times 10^{-16}$ | | $3.51 \times 10^{-16}$ | | $4.72 \times 10^{-16}$ | | $3.10 \times 10^{-16}$ | | $4.80 \times 10^{-16}$ | | $3.05 \times 10^{-16}$ | |
| | fusibility | peeling strength (N/25 mm) HDPE | 42 | | 70 | | 87 | | 54 | | 52 | | 40 | | 76 | |
| | | L-LDPE | 86 | | 125 | | 110 | | 150 | | 165 | | 70 | | 115 | |

Note:

"Parts" and "%" mean "parts by mass" and "mass %", respectively.

TABLE 5

| | | | Comparative Example 1 | | Comparative Example 2 | | Comparative Example 3 | | Comparative Example 4 | | Comparative Example 5 | | Reference Example 1 | |
|---|---|---|---|---|---|---|---|---|---|---|---|---|---|---|
| | | | parts | % | parts | % | parts | % | parts | % | parts | % | parts | % |
| composition | component A | SIBSTAR 062T | 100 | 80 | 100 | 80 | 100 | 70 | — | — | — | — | 100 | — |
| | | SIBSTAR 102T | — | — | — | — | — | — | 100 | 87 | — | — | — | — |
| | | Krayton G1643 | — | — | — | — | — | — | — | — | 100 | 69 | — | — |
| | | INFUSE 9007 | 25 | 20 | — | — | — | — | — | — | — | — | — | — |

TABLE 5-continued

| | | | Comparative Example 1 | | Comparative Example 2 | | Comparative Example 3 | | Comparative Example 4 | | Comparative Example 5 | | Reference Example 1 | |
|---|---|---|---|---|---|---|---|---|---|---|---|---|---|---|
| | | | parts | % | parts | % | parts | % | parts | % | parts | % | parts | % |
| | component B | Petrosen 175 | — | — | — | — | 42.9 | 30 | — | — | — | — | — | — |
| | | PM802A | — | — | — | — | — | — | 15 | 13 | 45 | 31 | — | — |
| | component D | DYNARON 6200P | — | — | 25 | 20 | — | — | — | — | — | — | — | — |
| properties | flexibility | A hardness | 45 | | 44 | | 75 | | 61 | | 86 | | 40 | |
| | fluidity | MFR (g/10 min) | 0.5 | | 2.2 | | 0.9 | | 0.1 | | 4.1 | | 0.4 | |
| | gas barrier property | water vapor permeability ($g/m^2 \cdot 24$ h) (when thickness is 0.5 mm) | 2.0 | | 2.3 | | 0.9 | | 0.8 | | 4.0 | | 1.1 | |
| | | oxygen permeability ($mol \cdot m/Pa \cdot s \cdot m^2$) | $3.94 \times 10^{-16}$ | | $2.49 \times 10^{-16}$ | | $5.54 \times 10^{-16}$ | | $3.70 \times 10^{-16}$ | | $5.00 \times 10^{-15}$ | | $0.24 \times 10^{-15}$ | |
| | fusibility | peeling strength (N/25 mm) HDPE | 63 | | 54 | | 32 | | 31 | | 67 | | 22 | |
| | | L-LDPE | 160 | | 155 | | 101 | | 136 | | 86 | | 60 | |

Note:
"Parts" and "%" mean "parts by mass" and "mass %", respectively.

From the results shown in above Table 4 and Table 5, it can be understood that the composite molded bodies of Examples 1~7 have excellent air barrier property of the elastomer composition, and the fusion of the elastomer composition and the polyethylene resin also is strong.

In contrast, in Comparative Example 1 and Comparative Example 2 in which the elastomer composition does not contain polyethylene resin, the water vapor permeability exceeds 2.0 $g/m^2 \cdot 24$ h, and the water vapor barrier property is inferior to those of Examples 1~7. In Comparative Example 3 in which the elastomer composition contains a low-density polyethylene resin that is a high-pressure polyethylene resin as the polyethylene resin, and in Comparative Example 4 in which elastomer composition contains polypropylene resin instead of polyethylene resin, the fusibility with respect to HDPE is insufficient. Further, in Comparative Example 5 that contains SEBS instead of an isobutylene block copolymer, the water vapor permeability exceeds 2.0 $g/m^2 \cdot 24$ h, and the water vapor barrier property is inferior to those of Examples 1~7.

Note that Reference Example 1 is the results of measuring the properties of "SIBSTAR 062T" of component A in the same way as the elastomer compositions of the Examples and Comparative Examples. It can be understood that the isobutylene block copolymer itself hardly fuses at all to HDPE, but fusibility to HDPE occurs due to mixing with a predetermined amount of a medium/low-pressure polyethylene resin.

(Operation and Effects)

Operation and effects of the present embodiment are described next. Note that, in the following explanation, when comparative forms for comparison with the embodiment are discussed, if parts or the like that are similar to those of the container 10 of the embodiment are used, description is given by using as is the reference numerals and names of those parts or the like.

Figure 7:
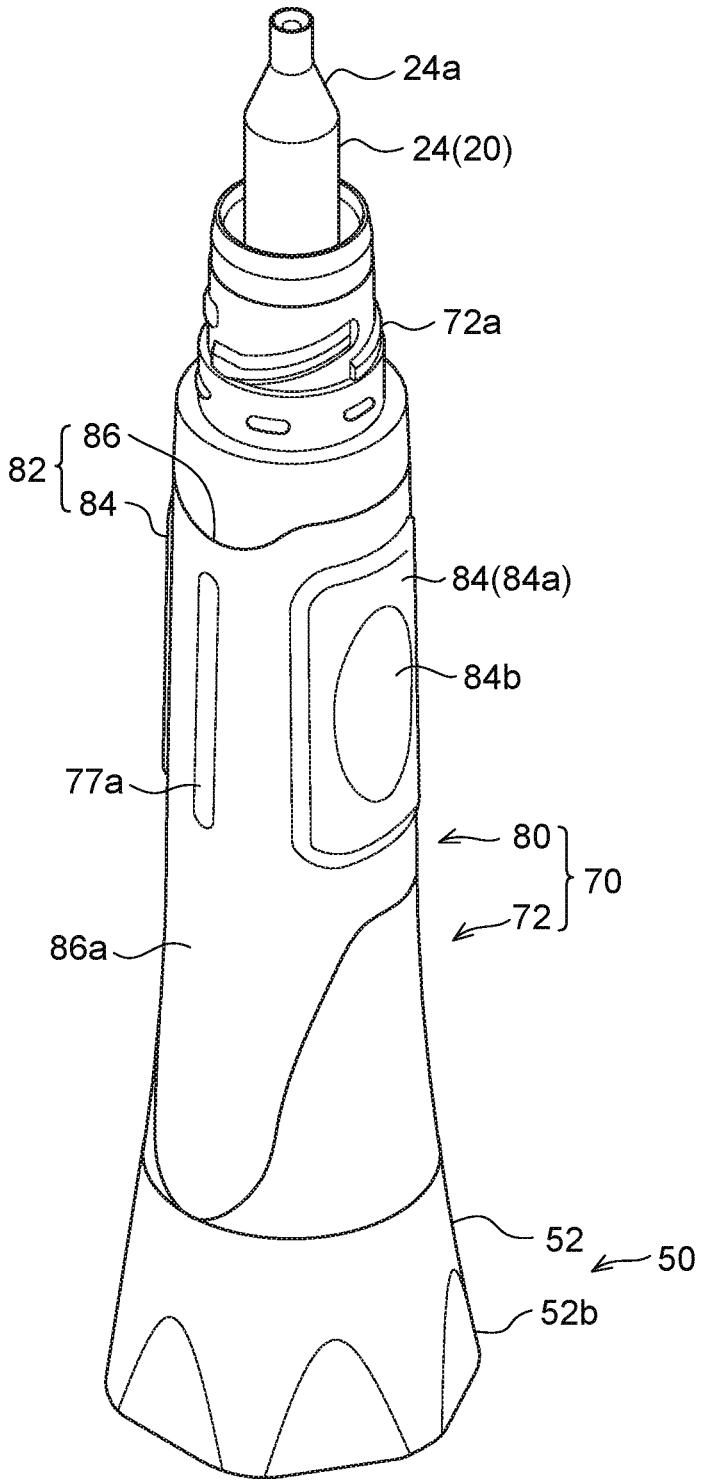
FIG. 7 is a perspective view, in the state in which the cap is removed, of the container relating to the embodiment of the present disclosure.

The container 10 of the embodiment has a structure in which the opening portions 74 formed in the outer peripheral wall of the outer container 70 are covered by the pressing portions 84 that are formed of an elastomer. Accordingly, as illustrated in FIG. 4 and FIG. 7, at the container 10, when the cap 40 is removed from the outer container 70, due to the pressing portions 84 being pressed by fingers or the like and the main body portion 22 of the inner container 20 being pressed, the contents of the inner container 20 can easily be expelled from the nozzle portion 24.

Further, the container 10 of the embodiment has a structure in which the cap 40 is detachably provided at the outer container 70. Moreover, at the container 10 of the embodiment, the cap 40 is attached to the outer container 70, and covers the nozzle portion 24 of the inner container 20 that projects-out from the outer container 70. Due thereto, as compared with a structure in which the cap 40 is detachably provided at the inner container 20, the air barrier property of the container 10 can be improved.

Further, the container 10 of the embodiment has a structure in which the outer container 70 that is made of a hard resin contains the inner container 20. Accordingly, at the container 10 of the embodiment, even if the container 10 is inadvertently pressed, the contents being expelled from the nozzle portion 24 of the inner container 20 is suppressed.

Further, the container 10 of the embodiment has a structure that is provided with the base 50 at the end portion of the outer container 70 which is at the side opposite the cap 40. Accordingly, at the container 10 of the embodiment, the container 10 can be stood-up on a work table or the like in a state in which the base 50 is down and the distal end portion 24*a* of the nozzle portion 24 is made to face upward. Due thereto, when the user of the container 10 suspends the activity of expelling the contents that are filled in the inner container 20, the user can stand the container 10 up on the work table or the like, and make it such that the contents do not leak out from the nozzle portion 24.

Further, the container 10 of the embodiment has a structure in which the pair of opening portions 74 are provided so as to have axial symmetry with respect to the central axis of the outer container 70. Accordingly, at the container 10 of the embodiment, at the time of pressing the pair of pressing portions 84 and expelling the contents from the nozzle portion 24, it is easy to pinch and press the pair of pressing portions 84 by the thumb and index finger (see FIG. 10).

Further, the container 10 of the embodiment has the connecting portion 86 that integrally connects the pair of pressing portions 84 as if wound on the outer peripheral wall of the outer container 70. Accordingly, at the container 10 of the embodiment, peeling off of the pressing portions 84 from the outer container 70 is suppressed as compared with a structure in which the pair of pressing portions 84 are not connected integrally.

Further, the container 10 of the embodiment has the first extending portion 86*a* that extends from the connecting portion 86 toward the base 50. Accordingly, at the container 10 of the embodiment, by making the fused surface area of the elastomer portion 80 to the outer container 70 be large as compared with a structure that does not have the first extending portion 86*a*, peeling of the pressing portions 84 from the outer container 70 is suppressed.

Further, the container 10 of the embodiment has a structure in which the plural ribs 42*c* are formed at the outer peripheral wall of the outer tube portion 42 of the cap 40. Accordingly, at the container 10 of the embodiment, because the fingers catch on the ribs at the time when the user attaches/removes the cap 40 by a manual operation, it can be made easy for the user to grasp the cap.

Further, the container 10 of the embodiment has a structure in which the diameter of the outer peripheral wall of the outer container 70 increases from the end portion at the cap 40 side toward the base 50. Accordingly, it is difficult for the container 10 of the embodiment to fall over when placed on a work table or the like with the distal end portion 24*a* of the nozzle portion 24 facing up.

Further, the container 10 of the embodiment has a structure in which the contents of the inner container 20 are an adhesive. Accordingly, due to the container 10 of the embodiment having an air barrier property, it is difficult for the adhesive that is filled in the inner container 20 to deteriorate at times of non-usage.

Further, the container 10 of the embodiment has a structure in which the inner container 20 is made of polyolefin. Accordingly, at the container 10 of the embodiment, it is difficult for the adhesive that remains at the inner side of the nozzle portion 24 to harden.

Further, the container 10 of the embodiment has a structure in which the cap 40 is made of polyolefin. Accordingly, at the container 10 of the embodiment, it is difficult for the adhesive that remains in the distal end portion 24*a* of the nozzle portion 24, which is covered by the cap 40, to harden.

Further, the container 10 of the embodiment has a structure having the drying agent 60 at the inner side of the base 50. Accordingly, due to the container 10 of the embodiment absorbing moisture that is contained in the air within the internal space of the container 10, that space can be dried.

Further, the container 10 of the embodiment has a structure in which the concave portions 84*b* are formed at the surfaces of the pressing portions 84. Accordingly, at the container 10 of the embodiment, the thumb and index finger can be fit in the concave portions 84*b* when pressing the pressing portions 84 (see FIG. 10).

Further, at the container 10 of the embodiment, the pressing portions 84 have the bulging portions 84*a*. Accordingly, at the container 10 of the embodiment, the user can distinguish the positions of the pressing portions 84 by touch.

Further, the container 10 of the embodiment has a structure in which the maximum thickness $T_{max}$ of the bulging portions 84*a* is within the range of greater than or equal to 0.2 mm and less than or equal to 1.0 mm. Accordingly, at the container 10 of the embodiment, as compared with a structure in which the maximum thickness $T_{max}$ of the bulging portions 84*a* is less than 0.2 mm, it is easy for the user to distinguish the positions of the pressing portions 84 by touch. Further, at the container 10 of the embodiment, as compared with a structure in which the maximum thickness $T_{max}$ of the bulging portions 84*a* exceeds 1.0 mm, it is easy to press the inner container 20 by pressing the pressing portions 84 by the thumb and index finger.

Further, the container 10 of the embodiment has a structure in which the A hardness of the elastomer composition X is within the range of greater than or equal to 40 and less than 80. Accordingly, at the container 10 of the embodiment, as compared with a structure in which the A hardness of the elastomer that forms the pressing portions 84 is less than 40, it is easy to adjust the amount of the contents that is expelled by pressing the pressing portions 84. Further, at the container 10 of the embodiment, as compared with a structure in which the A hardness of the elastomer that forms the pressing portions 84 is greater than or equal to 80, it is easy to adjust the amount of the contents that is expelled by pressing the pressing portions 84.

Further, the container 10 of the embodiment has a structure in which the water vapor permeability of elastomer composition X at a sample of a thickness of 0.5 mm, as measured in accordance with JIS Z 0208, is less than 2.0 $g/m^2 \cdot 24$ h. Accordingly, at the container 10 of the embodiment, the water vapor barrier property of the container 10 is improved as compared with a structure in which the water vapor permeability at a sample of a thickness of 0.5 mm of the elastomer that forms the pressing portions 84 is greater than or equal to 2.0 $g/m^2 \cdot 24$ h.

Further, the container 10 of the embodiment is a structure in which the oxygen permeability measured in accordance with JIS K 7126 is less than $1.0 \times 10^{-15}$ $mol \cdot m/Pa \cdot s \cdot m^2$. Accordingly, at the container 10 of the embodiment, the air barrier property of the container 10 is improved as compared with a structure in which the oxygen permeability of the elastomer forming the pressing portions 84 is greater than or equal to $1.0 \times 10^{-15}$ $mol \cdot m/Pa \cdot s \cdot m^2$.

Although an embodiment of the present disclosure has been described in detail above, the present disclosure is not limited to the above-described embodiment, and various modifications, changes and improvements are possible within the scope of the technical concept of the present disclosure.

For example, the container 10 of the embodiment has the base 50. However, the container 10 of the present disclosure may be a structure that does not have the base 50, provided that the container 10 has an air barrier property with respect to the inner container 20 at only the outer container 70 and the cap 40.

Further, the opening portions 74 in the embodiment are provided as a pair that has axial symmetry with respect to the central axis of the outer container 70. However, the opening portions 74 relating to the present disclosure are not limited to being provided as a pair having axial symmetry with respect to the central axis of the outer container 70. There may be a structure in which only one of the opening portions 74 in the present disclosure is provided at the outer peripheral wall of the outer container 70, or there may be a structure in which three or more of the opening portions 74 are provided. Further, the plural opening portions 74 provided at the outer container 70 in the present disclosure may be structures that do not have axial symmetry with respect to the central axis of the outer container 70.

Further, the container 10 of the embodiment has a structure in which the pair of pressing portions 84 are made integral and connected by the connecting portion 86. However, the pair of pressing portions 84 relating to the present disclosure may be structures that are not integral and connected.

Further, the container 10 of the embodiment has the first extending portion 86*a*. However, the container 10 relating to the present disclosure may be a structure that does not have the first extending portion 86*a*. Further, the container 10 relating to the present disclosure may be a structure in which the first elastomer portion 82 and the second elastomer portion 90 are not connected. Further, the container 10 relating to the present disclosure may be a structure that does not have the second elastomer portion 90.

Further, the cap 40 of the embodiment is a structure at which the ribs 42*c* are formed. However, the cap 40 relating to the present disclosure may be a structure at which the ribs 42*c* are not formed.

Further, the outer container 70, the cap 40 and the base 50 relating to the embodiment have structures in which the diameters thereof increase from the cap 40 side end portion toward the base 50. However, the outer container 70, the cap 40 and the base 50 relating to the present disclosure may be structures that are not structured such that the diameters thereof increase or decrease, and may be structures in which the outer diameters of the respective outer peripheral walls thereof are uniform. Further, the outer container 70, the cap 40 and the base 50 relating to the present disclosure may be structures in which the respective outer peripheral walls thereof are different, and are not flush with one another.

Further, the concave portions 84*b* of the pressing portions 84 in the embodiment are oval as seen from the radial direction. However, the concave portions 84*b* in the present disclosure are not limited to oval shapes. As seen from the radial direction, the concave portions 84*b* relating to the present disclosure may be circular or may be teardrop shaped. Further, as seen from the radial direction, the concave portions 84*b* in the present disclosure may be polygonal, such as triangular, quadrangular, or the like.

Further, in the present embodiment, the concave portions 84*b*, which are concave with respect to the bulging portions 84*a*, are formed at the bulging portions 84*a* of the pressing portions 84. However, convex portions, which are convex with respect to the bulging portions 84*a*, may be formed at the bulging portions 84*a* relating to the present disclosure. Further, the concave portions 84*b* or such convex portions do not have to be formed at the pressing portions 84 relating to the present disclosure.

Further, at the container 10 of the embodiment, the pressing portions 84 are structures having the bulging portions 84*a*. However, at the container 10 relating to the present disclosure, the pressing portions 84 do not have to have the bulging portions 84*a*.

Further, at the container 10 of the embodiment, the elastomer portion 80 is substantially flush with the outer peripheral wall of the main body portion 72 of the outer container 70. However, the elastomer portion 80 relating to the present disclosure may be a structure having a step with respect to the outer peripheral wall of the main body portion 72 of the outer container 70.

Further, at the container 10 of the embodiment, the main body portion 72 of the outer container 70 is a structure that is substantially cylindrical tube shaped. However, provided that the outer container 70 relating to the present disclosure is a tubular structure, it is not limited to a substantially cylindrical tube shaped structure, and may be a tubular structure that is substantially rectangular as seen from the radial direction.

Further, the container 10 of the embodiment is a structure having the drying agent 60. However, the container 10 relating to the present disclosure does not have to have the drying agent 60.

The disclosure of Japanese Patent Application No. 2020-193893 filed on Nov. 20, 2020 is, in its entirety, incorporated by reference into the present specification. All publications, patent applications, and technical standards mentioned in the present specification are incorporated by reference into the present specification to the same extent as if such individual publication, patent application, or technical standard was specifically and individually indicated to be incorporated by reference.

The invention claimed is:

1. A container, comprising:

an inner container having a nozzle portion that discharges loaded content;

an outer container that is tubular, is formed of a hard resin, contains the inner container, and has an outer peripheral wall in which an opening portion is formed;

a pair of pressing portions formed of an elastomer, provided at the outer peripheral wall, and covering the opening portion;

a connecting portion that is made of an elastomer and integrally connects the pair of pressing portions and is wound in a peripheral direction on the outer peripheral wall of the outer container;

a cap that is attachable to and removable from the outer container, and that covers the nozzle portion that projects out from the outer container;

a base including an outer tube portion attached at an end portion of the outer container at an opposite side from the cap, the base including an inner tube portion disposed radially within the outer tube portion; and a drying agent contained within the inner tube portion of the base, wherein the outer peripheral wall of the outer container tapers from a base end of the outer container to a cap end of the outer container, wherein an air gap is defined between the inner container and outer container and between the inner tube portion and the outer tube portion, and wherein the drying agent is configured to absorb moisture that is contained in the air gap.

2. The container of claim 1, wherein a pair of the opening portions covered by the pressing portions are provided so as to have axial symmetry with respect to a central axis of the outer container.

3. The container of claim 1, further comprising an extending portion that is made of an elastomer and extends from the connecting portion toward the base of the outer container.

4. The container of claim 1, wherein a plurality of ribs are formed at an outer peripheral portion of the cap.

5. The container of claim 1, wherein the content is an adhesive.

6. The container of claim 5, wherein the inner container is made of polyolefin.

7. The container of claim 6, wherein the cap is made of polyolefin.

8. The container of claim 1, wherein the pressing portion has a bulging portion that bulges out further than the outer peripheral wall of the outer container, and wherein a concave portion is formed at the central portion of the surface of the bulging portion.

9. The container of claim 8, wherein a maximum thickness of the bulging portion is within a range of from 0.2 mm to 1.0 mm.

10. The container of claim 1, wherein a hardness A of the elastomer is within a range of from 40 to less than 80.

11. The container of claim 1, wherein water vapor permeability at a sample of a thickness of 0.5 mm of the elastomer, as measured in accordance with JIS Z 0208, is less than 2.0 $g/m^2 \cdot 24$ h.

12. The container of claim 1, wherein oxygen permeability of the elastomer, as measured in accordance with JIS K 7126, is less than $1.0\times10^{-15}$ mol·m/Pa·s·m$^2$.

* * * * *